US010650759B2

(12) United States Patent
An et al.

(10) Patent No.: US 10,650,759 B2
(45) Date of Patent: May 12, 2020

(54) DISPLAY APPARATUS AND METHOD OF DRIVING THE SAME

(71) Applicant: Samsung Display Co., Ltd., Yongin-si (KR)

(72) Inventors: Taehyeong An, Hwaseong-si (KR); Jeongbong Lee, Hwaseong-si (KR); Yujin Kim, Suwon-si (KR); Gyuhun Han, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 161 days.

(21) Appl. No.: 15/635,121

(22) Filed: Jun. 27, 2017

(65) Prior Publication Data

US 2018/0061336 A1 Mar. 1, 2018

(30) Foreign Application Priority Data

Aug. 24, 2016 (KR) ..... 10-2016-0107880

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/08* (2013.01); *G09G 2320/0653* (2013.01); *G09G 2340/0435* (2013.01)

(58) Field of Classification Search
None
See application file for complete search history.

(56) References Cited

U.S. PATENT DOCUMENTS

2007/0252803 A1* 11/2007 Fukui ..... G09G 3/3614 345/96
2015/0302812 A1 10/2015 Jeong et al.
2016/0071454 A1* 3/2016 Sohn ..... G09G 3/3614 345/212

FOREIGN PATENT DOCUMENTS

KR 10-1999-0047243 7/1999
KR 10-2015-0120589 10/2015

* cited by examiner

*Primary Examiner* — Benjamin C Lee
*Assistant Examiner* — Krishna P Neupane
(74) *Attorney, Agent, or Firm* — H.C. Park & Associates, PLC

(57) ABSTRACT

A display apparatus including a display panel, a gate driving part and a data driving part. The display panel is configured to display an image, and includes a gate line and a data line. The gate driving part is configured to output a gate signal to the gate line. The data driving part is configured to output a data signal to the data line, and to change a transition time when the data signal transits from a low level to a high level, according to at least one of a change of an inversion method for driving the display panel, and a change of a frame frequency of the image.

20 Claims, 15 Drawing Sheets

DISPLAY APPARATUS AND METHOD OF DRIVING THE SAME

CROSS-REFERENCE TO RELATED APPLICATION

This application claims priority from and the benefit of Korean Patent Application No. 10-2016-0107880, filed on Aug. 24, 2016, which is hereby incorporated by reference for all purposes as if fully set forth herein.

BACKGROUND

Field

Exemplary embodiments relate to an image display. More particularly exemplary embodiments relate to a display apparatus and a method of driving the display apparatus.

Discussion of the Background

A display apparatus includes a display panel and a display panel driving apparatus.

The display panel includes a gate line, a data line, and a pixel defined by the gate line and the data line.

The display panel driving apparatus includes a gate driving part, a data driving part, and a timing controlling part. The gate driving part outputs a gate signal to the gate line. The data driving part outputs a data signal to the data line. The timing controlling part controls a timing of the gate driving part and a timing of the data driving part.

In order to prevent degradation of a liquid crystal in the display panel, the display panel driving apparatus may drive the display panel using an inversion method. Specifically, the data driving part outputs, to the data line of the display panel, a data signal of a first polarity and a data signal of a second polarity which is inverted to the first polarity. The inversion method may include a column inversion method and a dot inversion method.

When the inversion method is changed, a rapid luminance change is generated in the display panel. For example, when the inversion method is changed from the column inversion method to the dot inversion method, a charge time period, in which a data voltage of the data signal is charged in the pixel, is rapidly decreased. Thus, a luminance of the display panel is rapidly decreased.

In addition, when a frame frequency of an image is changed, a rapid luminance change is generated in the display panel. For example, when the frame frequency of the image is changed from about 60 Hz to about 144 Hz, the charge time period is also rapidly decreased, and thus, the luminance of the display panel is rapidly decreased.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a display apparatus capable of improving display quality of the display apparatus.

Exemplary embodiments also provide a method of driving the above-mentioned display apparatus.

Additional aspects will be set forth in the detailed description which follows, and, in part, will be apparent from the disclosure, or may be learned by practice of the inventive concept.

An exemplary embodiment of the inventive concept discloses a display apparatus including a display panel, a gate driving part and a data driving part. The display panel is configured to display an image, and includes a gate line and a data line. The gate driving part is configured to output a gate signal to the gate line. The data driving part is configured to output a data signal to the data line, and to change a transition time in which the data signal transits from a low level to a high level, according to at least one of a change of an inversion method for driving the display panel, and a change of a frame frequency of the image.

The inversion method may include a column inversion method in which polarities of the data signal applied to the data line are alternately inverted in a plurality of frame periods, and a dot inversion method in which the polarities of the data signal applied to the data line are inverted in each of the frame periods.

In response to a change of the inversion method from the column inversion method to the dot inversion method, the data driving part may change the transition time of the data signal from a first time to a second time less than the first time.

The data driving part may maintain the transition time of the data signal as the second time during a first period, and the first period may include H (H is a natural number) frame periods.

The data driving part may change the transition time of the data signal from the second time to a third time between the first time and the second time after the first period, and may maintain the transition time of the data signal as the third time during a second period following the first period, and the second period may include I (I is a natural number) frame periods.

The data driving part may change the transition time of the data signal from the third time to the first time after the second period, and may maintain the transition time of the data signal as the first time during a third period following the second period, and the third period may include J (J is a natural number) frame periods.

In response to a change of the inversion method from the dot inversion method to the column inversion method, the data driving part may change the transition time of the data signal from a first time to a fourth time greater than the first time.

The data driving part may maintain the transition time of the data signal as the fourth time during a fourth period, and the fourth period may include K (K is a natural number) frame periods.

The data driving part may change the transition time of the data signal from the fourth time to a fifth time between the first time and the fourth time after the fourth period, and may maintain the transition time of the data signal as the fifth time during a fifth period following the fourth period, and the fifth period may include L (L is a natural number) frame periods.

The data driving part may change the transition time of the data signal from the fifth time to the first time after the fifth period, and may maintain the transition time of the data signal as the first time during a sixth period following the fifth period, and the sixth period may include M (M is a natural number) frame periods.

In an exemplary embodiment, in response to a change of the frame frequency from a first frequency to a second frequency higher than the first frequency, the data driving part may change the transition time of the data signal from a first time to a second time less than the first time.

The data driving part may maintain the transition time of the data signal as the second time during a seventh period, and the seventh period may include P (P is a natural number) frame periods.

The data driving part may change the transition time of the data signal from the second time to a third time between the first time and the second time after the seventh period, and may maintain the transition time of the data signal as the third time during an eighth period following the seventh period, and the eighth period may include Q (Q is a natural number) frame periods.

The data driving part may change the transition time of the data signal from the third time to the first time after the eighth period, and may maintain the transition time of the data signal as the first time during a ninth period following the eighth period, and the ninth period may include R (R is a natural number) frame periods.

In response to a change of the frame frequency from a second frequency to a first frequency lower than the first frequency, the data driving part may change the transition time of the data signal from a first time to a fourth time greater than the first time.

The data driving part may maintain the transition time of the data signal as the fourth time during a tenth period, and the tenth period may include S (S is a natural number) frame periods.

The data driving part may change the transition time of the data signal from the fourth time to a fifth time between the first time and the fourth time after the tenth period, and may maintain the transition time of the data signal as the fifth time during an eleventh period following the tenth period, and the eleventh period may include T (T is a natural number) frame periods.

The data driving part may change the transition time of the data signal from the fifth time to the first time after the eleventh period, and may maintain the transition time of the data signal as the first time during a twelfth period following the eleventh period, and the twelfth period may include U (U is a natural number) frame periods.

An exemplary embodiment of the present inventive concept also discloses a method of driving a display apparatus including outputting a gate signal to a gate line of a display panel configured to display an image and including the gate line and a data line, and outputting a data signal to the data line, by changing a transition time in which the data signal transits from a low level to a high level, according to at least one of a change of an inversion method for driving the display panel, and a change of a frame frequency of the image.

The changing the transition time may include changing the transition time, in response to a change of the inversion method from a column inversion method in which polarities of the data signal applied to the data line are alternately inverted in a plurality of frame periods, to a dot inversion method in which the polarities of the data signal applied to the data line are inverted in each of the frame periods, changing the transition time in response to a change of the inversion method from the dot inversion method to the column inversion method, changing the transition time in response to a change of the frame frequency from a first frequency to a second frequency higher than the first frequency, and changing the transition time in response to a change in the frame frequency from the second frequency to the first frequency.

According to the present inventive concept, a rapid change of a luminance of a display apparatus may be prevented. Therefore, a flicker phenomenon may be prevented, and thus display quality of the display apparatus may be improved.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
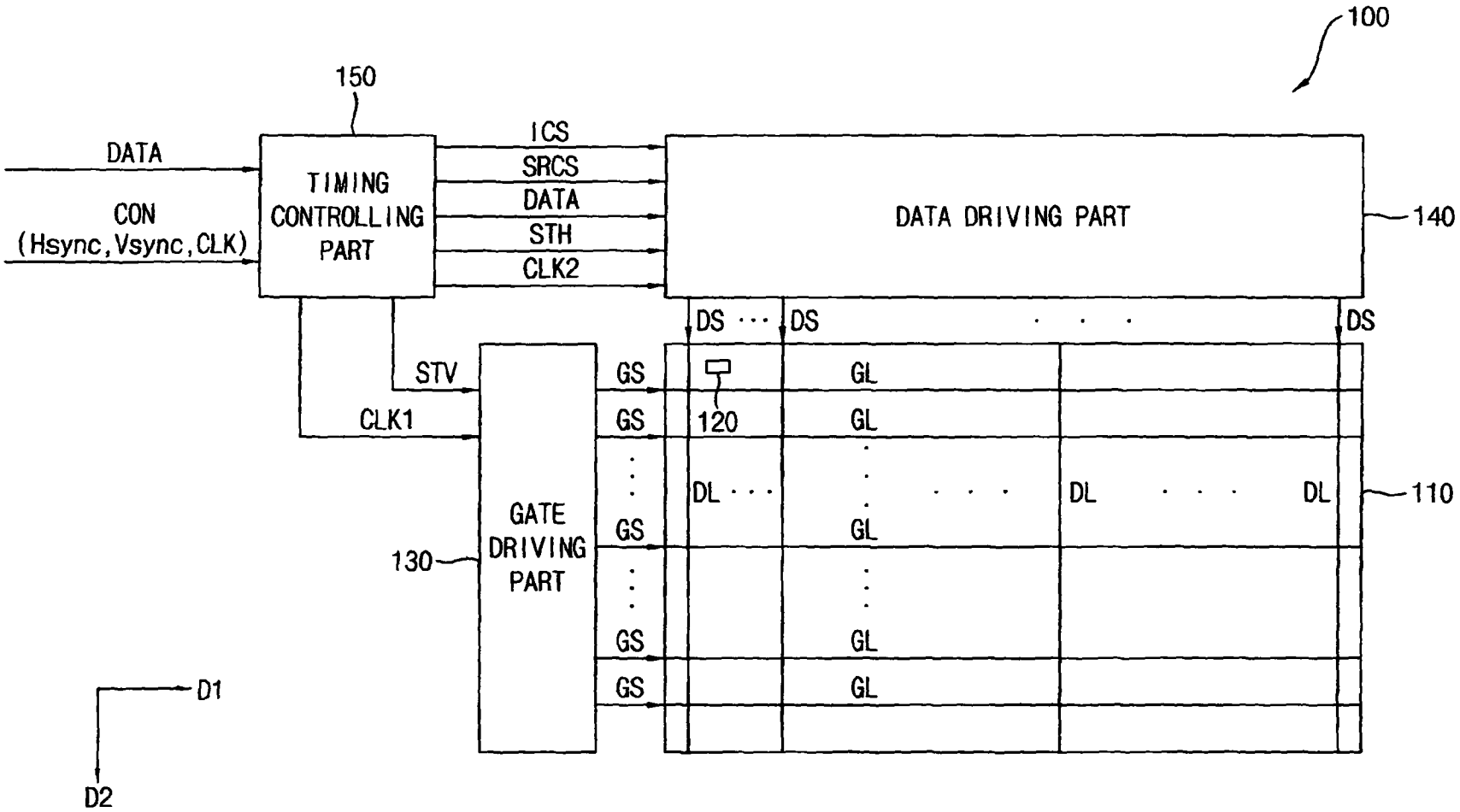
FIG. 1 is a block diagram illustrating a display apparatus according to an exemplary embodiment of the present inventive concept.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram illustrating a display apparatus according to an exemplary embodiment of the present inventive concept.

Referring to FIG. 1, a display apparatus 100 includes a display panel 110, a gate driving part 130, a data driving part 140, and a timing controlling part 150.

The display panel 110 receives a data signal DS from the data driving part 140 to display an image. The display panel 110 includes gate lines GL, data lines DL, and pixels 120. The gate lines GL extend in a first direction D1 and are arranged in a second direction D2 substantially perpendicular to the first direction D1. The data lines DL extend in the second direction D2 and are arranged in the first direction D1. Here, the first direction D1 may be parallel to a long side of the display panel 110, and the second direction D2 may be parallel to a short side of the display panel 110.

Figure 2:
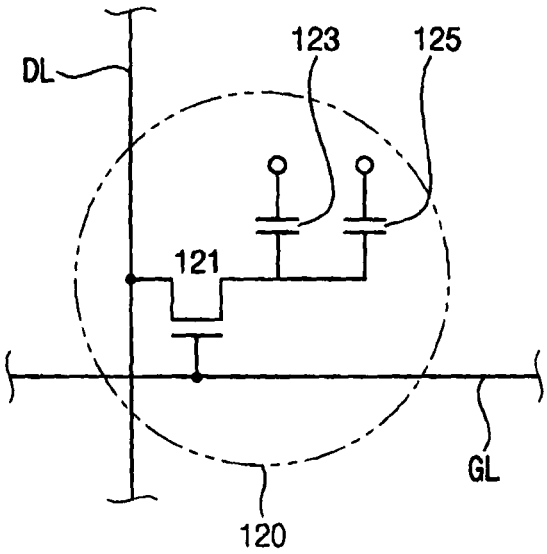
FIG. 2 is a circuit diagram illustrating a pixel of FIG. 1.

FIG. 2 is a circuit diagram illustrating the pixel 120 of FIG. 1.

Referring to FIGS. 1 and 2, the pixels 120 are defined for each of the gate lines GL and each of the data lines DL. For example, the pixel 120 may include a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel.

The gate driving part 130, the data driving part 140, and the timing controlling part 150 may be defined as a display panel driving apparatus for driving the display panel 110.

The gate driving part 130 generates gate signals GS in response to a vertical start signal STV and a first clock signal CLK1 provided from the timing controlling part 150, and outputs the gate signals GS to the gate lines GL.

The data driving part 140 receives image data DATA from the timing controlling part 150, generates the data signal DS based on the image data DATA, and outputs the data signal DS to the data line DL in response to a horizontal start signal STH and a second clock signal CLK2 provided from the timing controlling part 150.

The data driving part 140 drives the display panel 110 in an inversion method according to an inversion control signal ICS provided from the timing controlling part 150. The inversion method may include a column inversion method and a dot inversion method.

Figure 3A:
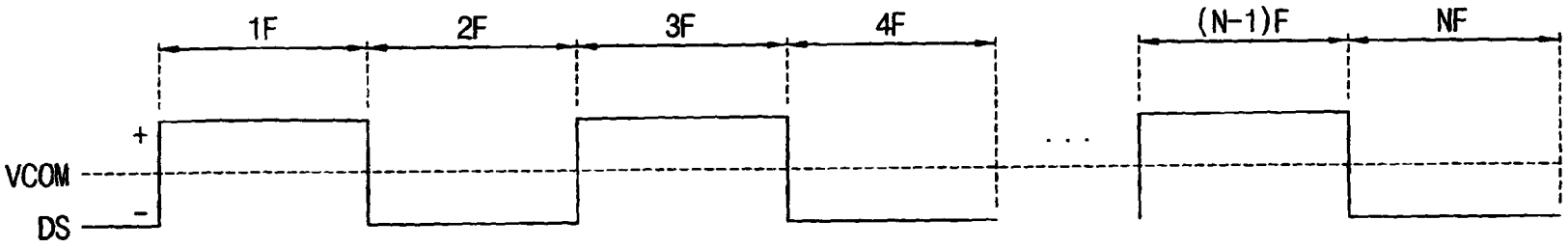
FIG. 3A is a waveform diagram illustrating a data signal when a data driving part of FIG. 1 drives a display panel in a column inversion method.

FIG. 3A is a waveform diagram illustrating the data signal DS when the data driving part 140 of FIG. 1 drives the display panel 110 in the column inversion method.

Referring to FIGS. 1 and 3A, in the column inversion method, the data driving part 140 may alternately invert polarities of the data signal DS applied to the data line DL in frame periods 1F, 2F, 3F, 4F, . . . , (N−1)F, and NF. For example, in a first frame period 1F the data signal DS may be greater than a common voltage VCOM and thus, the data signal DS may have a positive polarity; in a second frame period 2F, the data signal DS may be less than the common voltage VCOM and have a negative polarity; in a third frame period 3F, the data signal DS may be greater than the common voltage VCOM and have a positive polarity; in a fourth frame period 4F, the data signal DS may be less than the common voltage VCOM and have a negative polarity; in an (N−1)-th frame period (N−1)F, the data signal DS may be greater than the common voltage VCOM and have a positive polarity; and, in an N-th frame period NF, the data signal DS may be less than the common voltage VCOM and have a negative polarity.

Figure 3B:
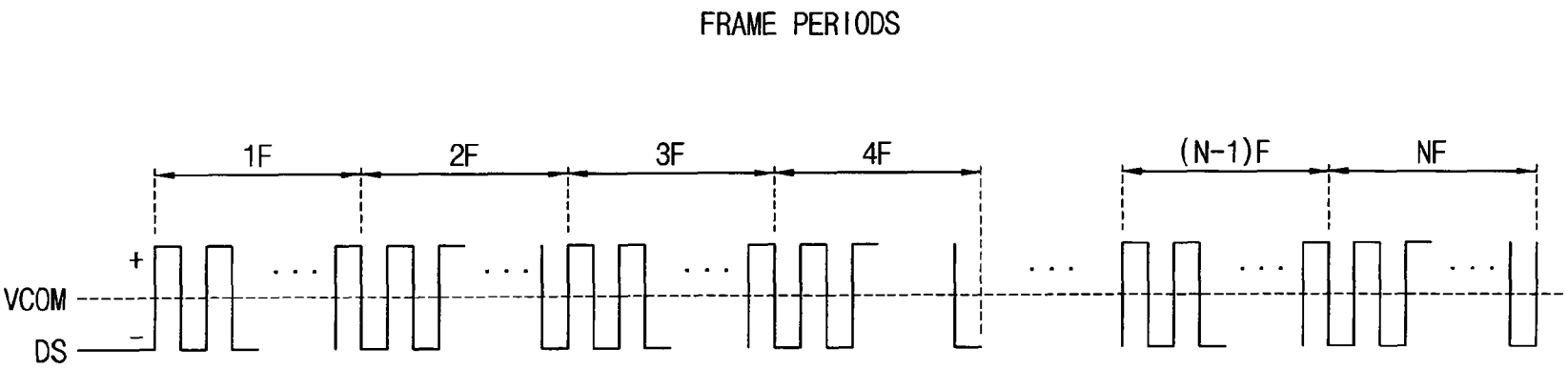
FIG. 3B is a waveform diagram illustrating the data signal when the data driving part of FIG. 1 drives the display panel in a dot inversion method.

FIG. 3B is a waveform diagram illustrating the data signal DS when the data driving part 140 of FIG. 1 drives the display panel 110 in the dot inversion method.

Referring to FIG. 1 and FIG. 3B, in the dot inversion method, the data driving part 140 inverts polarities of the data signal DS applied to the data line DL in each of the frame periods 1F, 2F, 3F, 4F, . . . , (N−1)F and NF. Thus, the data driving part 140 may invert the polarities of the data signal DS in the first frame period 1F; may invert the polarities of the data signal DS in the second frame period 2F; may invert the polarities of the data signal DS in the third frame period 3F; may invert the polarities of the data signal DS in the fourth frame period 4F; may invert the polarities of the data signal DS in the (N−1)-th frame period (N−1)F; and may invert the polarities of the data signal DS in the N-th frame period NF.

Referring to FIG. 1 again, the data driving part 140 controls a slew rate of the data signal DS according to a slew rate control signal SRCS provided from the timing controlling part 150. Thus, the data driving part 140 controls a transition time in which the data signal DS transits from a low level to a high level, according to the slew rate control signal SRCS. The greater the slew rate control signal SRCS, the greater the slew rate of the data signal DS may be. Thus, the greater the slew rate control signal SRCS, the shorter the transition time of the data signal DS may be.

When the inversion method is changed, the data driving part 140 may change the slew rate and the transition time of the data signal DS. Specifically, when the inversion method is changed from the column inversion method to the dot inversion method, the data driving part 140 may increase the slew rate of the data signal DS and may decrease the transition time of the data signal DS. In addition, when the inversion method is changed from the dot inversion method to the column inversion method, the data driving part 140 may decrease the slew rate of the data signal DS and may increase the transition time of the data signal DS.

Figure 4A:
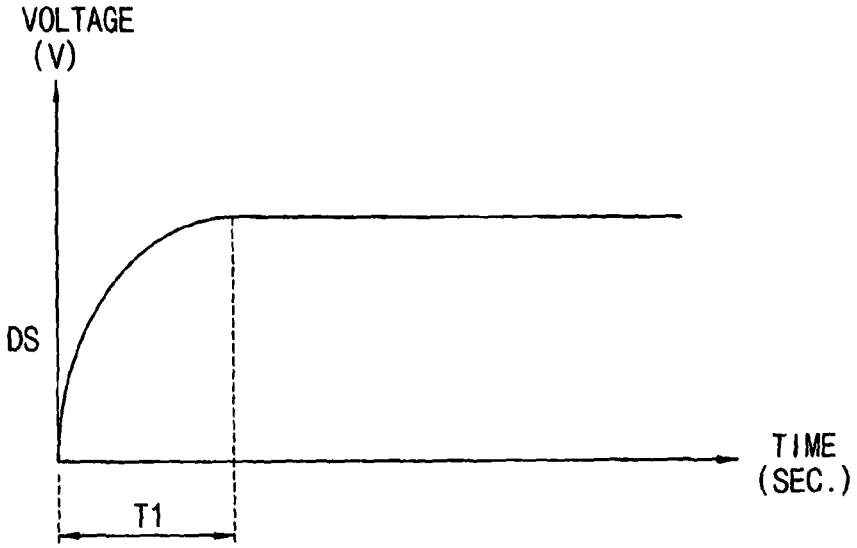
FIG. 4A is a graph illustrating the data signal when a slew rate control signal of FIG. 1 is a first level.

FIG. 4A is a graph illustrating the data signal DS when the slew rate control signal SRCS of FIG. 1 is a first level.

Referring to FIGS. 1 and 4A, when the slew rate control signal SRCS is the first level, the transition time of the data signal DS may be a first time T1. For example, the first level of the slew rate control signal SRCS may be referred to as "HLL".

Figure 4B:
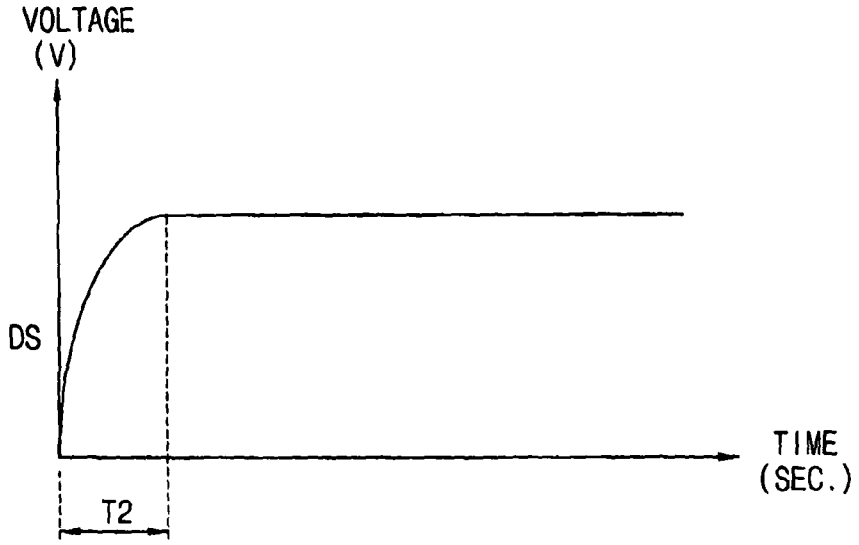
FIG. 4B is a graph illustrating the data signal when the slew rate control signal of FIG. 1 is a second level.

FIG. 4B is a graph illustrating the data signal DS when the slew rate control signal SRCS of FIG. 1 is a second level.

Referring to FIGS. 1, 4A and 4B, when the slew rate control signal SRCS is the second level, the transition time of the data signal DS may be a second time T2, which is less than the first time T1. Here, the second level is greater than the first level. For example, the second level of the slew rate control signal SRCS may be referred to as "HHH".

Figure 4C:
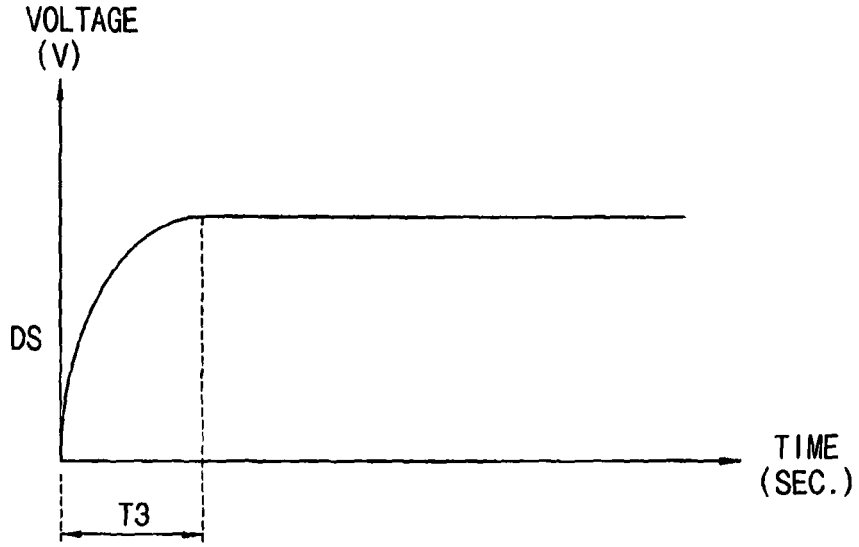
FIG. 4C is a graph illustrating the data signal when the slew rate control signal of FIG. 1 is a third level.

FIG. 4C is a graph illustrating the data signal DS when the slew rate control signal SRCS of FIG. 1 is a third level.

Referring to FIGS. 1, 4A, 4B and 4C, when the slew rate control signal SRCS is the third level, the transition time of the data signal DS may be a third time T3 between the first time T1 and the second time T2. Here, the third level is between the first level and the second level. For example, the third level of the slew rate control signal SRCS may be referred to as "HHL".

Figure 4D:
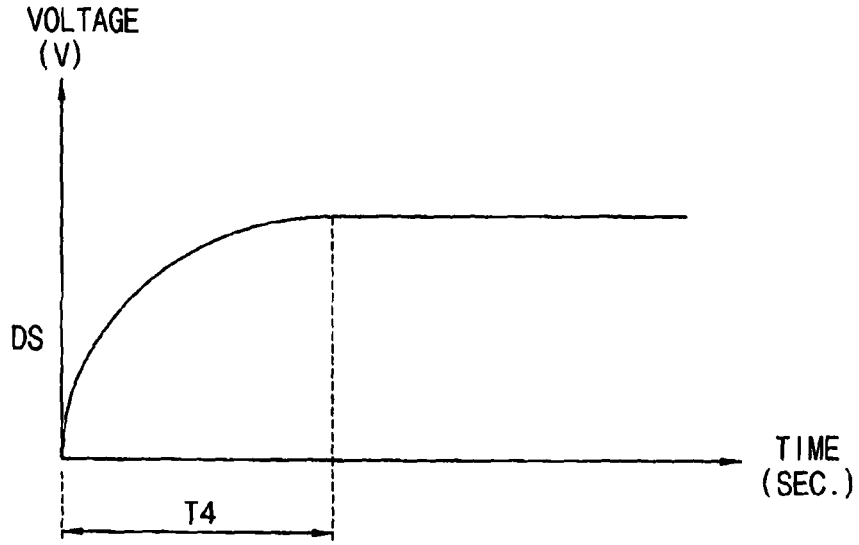
FIG. 4D is a graph illustrating the data signal when the slew rate control signal of FIG. 1 is a fourth level.

FIG. 4D is a graph illustrating the data signal DS when the slew rate control signal SRCS of FIG. 1 is a fourth level.

Referring to FIGS. 1, 4A and 4D, when the slew rate control signal SRCS is the fourth level, the transition time of the data signal DS may be a fourth time T4, which is greater than the first time T1. Here, the fourth level is less than the first level. For example, the fourth level of the slew rate control signal SRCS may be referred to as "LHL".

Figure 4E:
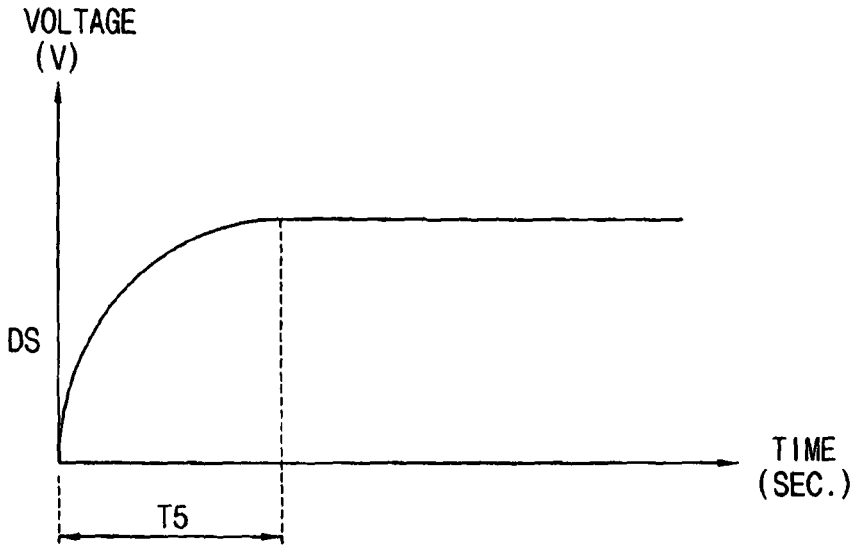
FIG. 4E is a graph illustrating the data signal when the slew rate control signal of FIG. 1 is a fifth level.

FIG. 4E is a graph illustrating the data signal DS when the slew rate control signal SRCS of FIG. 1 is a fifth level.

Referring to FIGS. 1, 4A, 4D and 4E, when the slew rate control signal SRCS is the fifth level, the transition time of the data signal DS may be a fifth time T5 between the first time T1 and the fourth time T4. Here, the fifth level is between the first level and the fourth level. For example, the fifth level of the slew rate control signal SRCS may be referred to as "LHH".

Referring to FIG. 1 again, the timing controlling part 150 receives the image data DATA and a control signal CON from an outside. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140. In addition, the timing controlling part 150 outputs the inversion control signal ICS and the slew rate control signal SRCS to the data driving part 140.

Figure 5:
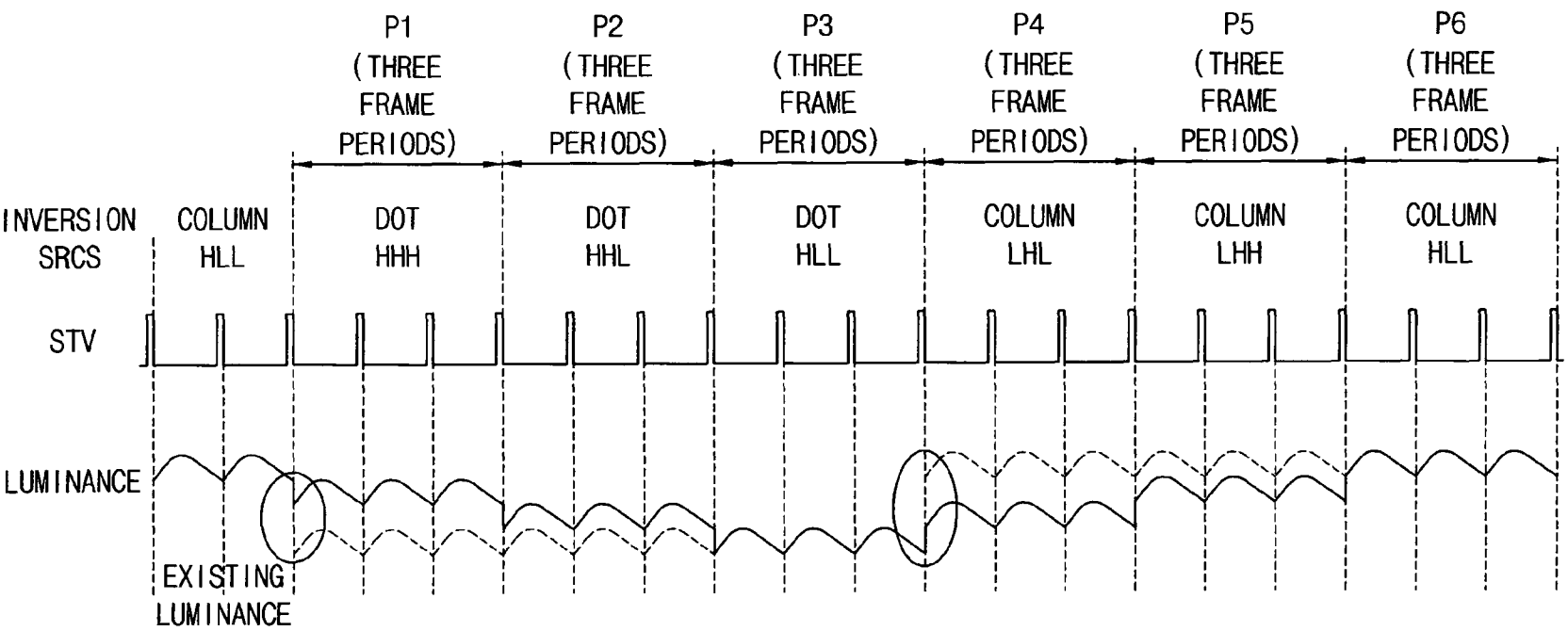
FIG. 5 is a view illustrating the slew rate control signal, a vertical start signal and a luminance of the display panel, according to an inversion method for driving the display panel of FIG. 1.

FIG. 5 is a view illustrating the slew rate control signal SRCS, the vertical start signal STV, and a luminance of the display panel 110, according to the inversion method for driving the display panel 110 of FIG. 1.

Referring to FIGS. 1 and 3A to 5, the data driving part 140 may drive the display panel 110 in the column inversion method. In this case, the level of the slew rate control signal SRCS may be "HLL", which is the first level. Thus, the data driving part 140 may control the data signal DS so that the transition time of the data signal DS becomes the first time T1.

When the inversion method is changed from the column inversion method to the dot inversion method, the level of the slew rate control signal SRCS may be changed from "HLL", which is the first level to "HHH", which is the second level. Thus, the data driving part 140 may change the transition time of the data signal DS from the first time T1 to the second time T2, which is less than the first time T1. Therefore, although the inversion method is changed from the column inversion method to the dot inversion method, the luminance of the display panel 110 is not rapidly decreased, as compared to the prior art to which the present inventive concept is not applied. The data driving part 140 may maintain the transition time of the data signal DS as the second time T2 during a first period P1. The first period P1 may include H (H is a natural number) frame periods. For example, the first period P1 may include three frame periods.

After the first period P1, the level of the slew rate control signal SRCS may be changed from "HHH", which is the second level, to "HHL", which is the third level. Thus, after the first period P1, the data driving part 140 may change the transition time of the data signal DS from the second time T2 to the third time T3 between the first time T1 and the second time T2. The data driving part 140 may maintain the transition time of the data signal DS as the third time T3 during a second period P2 following the first period P1. The second period P2 may include I (I is a natural number) frame periods. For example, the second period P2 may include three frame periods.

After the second period P2, the level of the slew rate control signal SRCS may be changed from "HHL", which is the third level, to "HLL", which is the first level. Thus, after the second period P2, the data driving part 140 may change the transition time of the data signal DS from the third time T3 to the first time T1. Therefore, the data driving part 140 may gradually recover the transition time of the data signal DS to the transition time before the inversion method is changed. The data driving part 140 may maintain the transition time of the data signal DS as the first time T1 during a third period P3 following the second period P2. The third period P3 may include J (J is a natural number) frame periods. For example, the third period P3 may include three frame periods.

When the inversion method is changed from the dot inversion method to the column inversion method, the level of the slew rate control signal SRCS may be changed from "HLL", which is the first level, to "LHL", which is the fourth level. Thus, the data driving part 140 may change the transition time of the data signal DS from the first time T1 to the fourth time T4 greater than the first time T1. Therefore, although the inversion method is changed from the dot inversion method to the column inversion method, the luminance of the display panel 110 is not rapidly increased, as compared to the prior art to which the present inventive concept is not applied. The data driving part 140 may maintain the transition time of the data signal DS as the fourth time T4 during a fourth period P4. The fourth period P4 may include K (K is a natural number) frame periods. For example, the fourth period P4 may include three frame periods.

After the fourth period P4, the level of the slew rate control signal SRCS may be changed from "LHL", which is the fourth level, to "LHH", which is the fifth level. Thus, after the fourth period P4, the data driving part 140 may change the transition time of the data signal DS from the fourth time T4 to the fifth time T5 between the first time T1 and the fourth time T4. The data driving part 140 may maintain the transition time of the data signal DS as the fifth time T5 during a fifth period P5 following the fourth period P4. The fifth period P5 may include L (L is a natural number) frame periods. For example, the fifth period P5 may include three frame periods.

After the fifth period P5, the level of the slew rate control signal SRCS may be changed from "LHH", which is the fifth level, to "HLL", which is the first level. Thus, after the fifth period P5, the data driving part 140 may change the transition time of the data signal DS from the fifth time T5 to the first time T1. Therefore, the data driving part 140 may gradually recover the transition time of the data signal DS to the transition time before the inversion method is changed. The data driving part 140 may maintain the transition time of the data signal DS as the first time T1 during a sixth period P6 following the fifth period P5. The sixth period P6 may include M (M is a natural number) frame periods. For example, the sixth period P6 may include three frame periods.

Figure 6A:
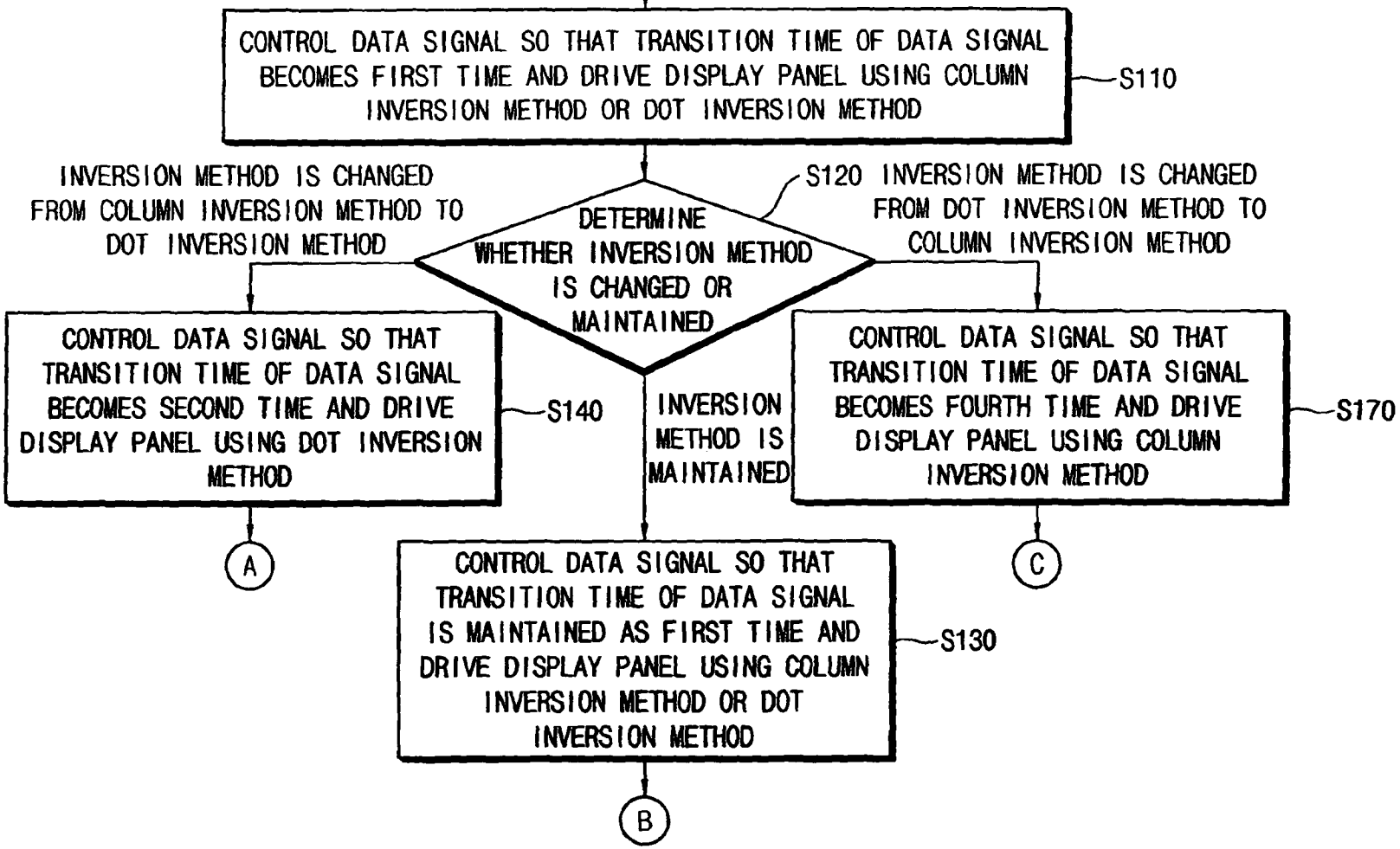
FIG. 6A and FIG. 6B are flow charts illustrating a method of driving the display apparatus of FIG. 1.
Figure 6B:
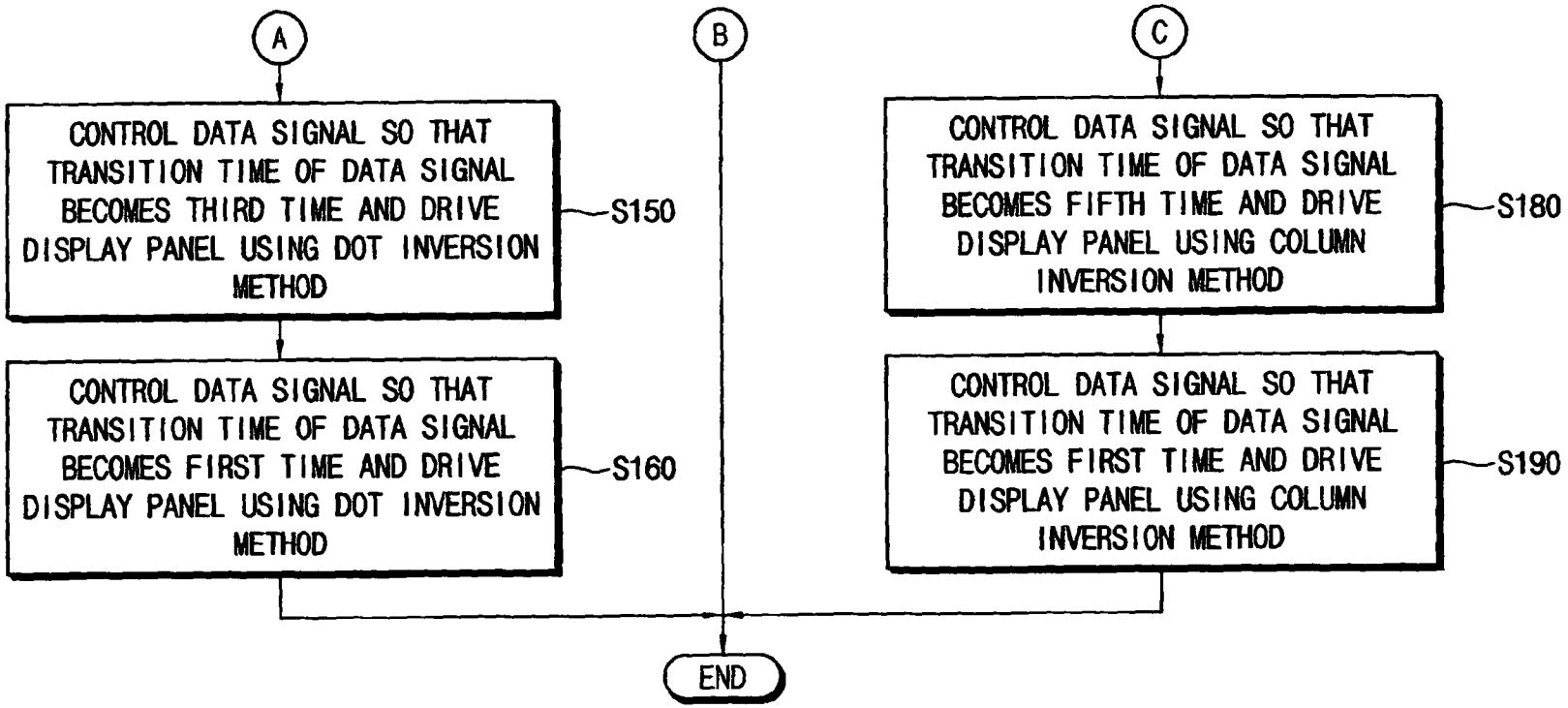

FIGS. 6A and 6B are flow charts illustrating a method of driving the display apparatus 100 of FIG. 1.

Referring to FIGS. 1 and 3A to 6B, the data signal DS is controlled so that the transition time of the data signal DS becomes the first time T1, and the display panel 110 is driven using the column inversion method or the dot inversion method (step S110). Specifically, the data driving part 140 may drive the display panel 110 in the column inversion method. In this case, the level of the slew rate control signal SRCS may be "HLL", which is the first level. Thus, the data driving part 140 may control the data signal DS so that the transition time of the data signal DS becomes the first time T1.

A change or a maintenance of the inversion method is determined (step S120). Specifically, since the timing controlling part 150 outputs the inversion control signal ICS to the data driving part 140, the timing controlling part 150 may determine the change or the maintenance of the inversion method.

When the inversion method is maintained, the data signal DS is controlled so that the transition time of the data signal DS is maintained as the first time T1 and the display panel 110 is driven using the column inversion method or the dot inversion method (step S130). Specifically, when the inversion method is maintained, the level of the slew rate control signal SRCS is maintained as "HLL", which is the first level, and thus, the data driving part 140 may control the data signal DS so that the transition time of the data signal DS is maintained as the first time T1.

When the inversion method is changed from the column inversion method to the dot inversion method, the data signal DS is controlled so that the transition time of the data signal DS becomes the second time T2 and the display panel 110 is driven using the dot inversion method (step S140). Specifically, when the inversion method is changed from the column inversion method to the dot inversion method, the level of the slew rate control signal SRCS may be changed from "HLL", which is the first level, to "HHH", which is the second level. Thus, the data driving part 140 may change the transition time of the data signal DS from the first time T1 to the second time T2 less than the first time T1. Therefore, although the inversion method is changed from the column inversion method to the dot inversion method, the luminance of the display panel 110 is not rapidly decreased, as compared to the prior art to which the present inventive concept is not applied. The data driving part 140 may maintain the transition time of the data signal DS as the second time T2 during the first period P1. The first period P1 may include H (H is a natural number) frame periods. For example, the first period P1 may include three frame periods.

The data signal DS is controlled so that the transition time of the data signal DS becomes the third time T3 and the display panel 110 is driven using the dot inversion method (step S150). Specifically, after the first period P1, the level of the slew rate control signal SRCS may be changed from "HHH", which is the second level, to "HHL", which is the third level. Thus, after the first period P1, the data driving part 140 may change the transition time of the data signal DS from the second time T2 to the third time T3 between the first time T1 and the second time T2. The data driving part 140 may maintain the transition time of the data signal DS as the third time T3 during the second period P2 following the first period P1. The second period P2 may include I (I is a natural number) frame periods. For example, the second period P2 may include three frame periods.

The data signal DS is controlled so that the transition time of the data signal DS becomes the first time T1 and the display panel 110 is driven using the dot inversion method (step S160). Specifically, after the second period P2, the level of the slew rate control signal SRCS may be changed from "HHL", which is the third level, to "HLL", which is the first level. Thus, after the second period P2, the data driving part 140 may change the transition time of the data signal DS from the third time T3 to the first time T1. Therefore, the data driving part 140 may gradually recover the transition time of the data signal DS to the transition time before the inversion method is changed. The data driving part 140 may maintain the transition time of the data signal DS as the first time T1 during the third period P3 following the second period P2. The third period P3 may include J (J is a natural number) frame periods. For example, the third period P3 may include three frame periods.

When the inversion method is changed from the dot inversion method to the column inversion method, the data signal DS is controlled so that the transition time of the data signal DS becomes the fourth time T4 and the display panel 110 is driven using the column inversion method (step S170). Specifically, when the inversion method is changed from the dot inversion method to the column inversion method, the level of the slew rate control signal SRCS may be changed from "HLL", which is the first level, to "LHL", which is the fourth level. Thus, the data driving part 140 may change the transition time of the data signal DS from the first time T1 to the fourth time T4, which is greater than the first time T1. Therefore, although the inversion method is changed from the dot inversion method to the column inversion method, the luminance of the display panel 110 is not rapidly increased, as compared to the prior art to which the present inventive concept is not applied. The data driving part 140 may maintain the transition time of the data signal DS as the fourth time T4 during the fourth period P4. The fourth period P4 may include K (K is a natural number) frame periods. For example, the fourth period P4 may include three frame periods.

The data signal DS is controlled so that the transition time of the data signal DS becomes the fifth time T5 and the display panel 110 is driven using the column inversion method (step S180). Specifically, after the fourth period P4, the level of the slew rate control signal SRCS may be changed from "LHL", which is the fourth level, to "LHH", which is the fifth level. Thus, after the fourth period P4, the data driving part 140 may change the transition time of the data signal DS from the fourth time T4 to the fifth time T5 between the first time T1 and the fourth time T4. The data driving part 140 may maintain the transition time of the data signal DS as the fifth time T5 during the fifth period P5 following the fourth period P4. The fifth period P5 may include L (L is a natural number) frame periods. For example, the fifth period P5 may include three frame periods.

The data signal DS is controlled so that the transition time of the data signal DS becomes the first time T1 and the display panel 110 is driven using the column inversion method (step S190). Specifically, after the fifth period P5, the level of the slew rate control signal SRCS may be changed from "LHH", which is the fifth level, to "HLL" which is the first level. Thus, after the fifth period P5, the data driving part 140 may change the transition time of the data signal DS from the fifth time T5 to the first time T1. Therefore, the data driving part 140 may gradually recover the transition time of the data signal DS to the transition time before the inversion method is changed. The data driving part 140 may maintain the transition time of the data signal DS as the first time T1 during the sixth period P6 following the fifth period P5. The sixth period P6 may include M (M is a natural number) frame periods. For example, the sixth period P6 may include three frame periods.

According to the present exemplary embodiment, when the inversion method is changed from the column inversion method to the dot inversion method, the rapid decrease of the luminance of the display panel 110 may be prevented. In addition, when the inversion method is changed from the dot inversion method to the column inversion method, the rapid increase of the luminance of the display panel 110 may be prevented. Therefore, a flicker phenomenon may be prevented, and thus display quality of the display apparatus 100 may be improved.

Figure 7:
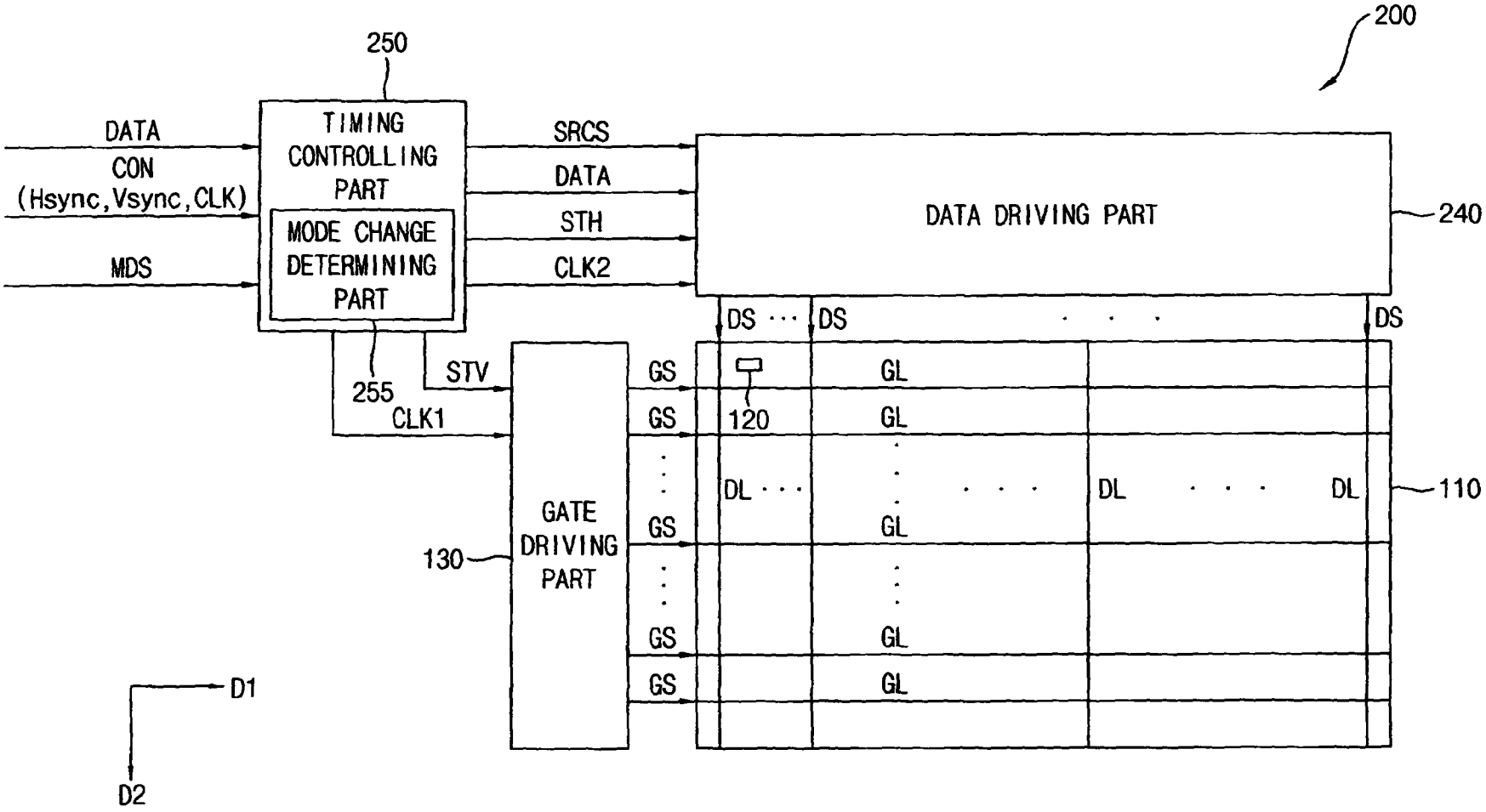
FIG. 7 is a block diagram illustrating a display apparatus according to an exemplary embodiment of the present inventive concept.

FIG. 7 is a block diagram illustrating a display apparatus according to an exemplary embodiment of the present inventive concept.

The display apparatus 200 according to the present exemplary embodiment illustrated in FIG. 7 may be substantially the same as the display apparatus 100 according to the previous exemplary embodiment illustrated in FIG. 1 except for a data driving part 240 and a timing controlling part 250. Thus, the same reference numerals will be used to refer to same or like parts as those described in the previous exemplary embodiment and any further repetitive explanation concerning the above elements will be omitted.

Referring to FIG. 7, the display apparatus 200 according to the present exemplary embodiment includes the display panel 110, the gate driving part 130, the data driving part 240 and the timing controlling part 250.

The display panel 110 receives the data signal DS from the data driving part 240 to display an image.

The gate driving part 130, the data driving part 240 and the timing controlling part 250 may be defined as a display panel driving apparatus for driving the display panel 110.

The gate driving part 130 generates the gate signals GS in response to the vertical start signal STV and the first clock signal CLK1 provided from the timing controlling part 250, and outputs the gate signals GS to the gate lines GL.

The data driving part 240 receives the image data DATA from the timing controlling part 250, generates the data signal DS based on the image data DATA, and outputs the data signal DS to the data line DL in response to the horizontal start signal STH and the second clock signal CLK2 provided from the timing controlling part 250.

The data driving part 240 controls the slew rate of the data signal DS according to the slew rate control signal SRCS provided from the timing controlling part 250. Thus, the data driving part 240 controls the transition time in which the data signal DS transits from a low level to a high level, according to the slew rate control signal SRCS. The greater the slew rate control signal SRCS, the greater the slew rate of the data signal DS may be. Thus, the greater the slew rate control signal SRCS, the shorter the transition time of the data signal DS may be.

When a display mode of the image is changed, the data driving part 240 may change the slew rate and the transition time of the data signal DS. Specifically, when the display mode is changed from a normal mode to a FreeSync™ mode, the data driving part 240 may increase the slew rate of the data signal DS, and may decrease the transition time of the data signal DS. In addition, when the display mode is changed from the FreeSync™ mode to the normal mode, the data driving part 240 may decrease the slew rate of the data signal DS and may increase the transition time of the data signal DS. Here, when the display mode is the normal mode, a frame frequency of the image may be a first frequency, and the display mode is the FreeSync™ mode, the frame frequency of the image may be a second frequency greater than the first frequency. For example, the first frequency may be about 60 Hz, and the second frequency may be about 144 Hz.

The timing controlling part 250 receives the image data DATA and the control signal CON from the outside. The control signal CON may include the horizontal synchronous signal Hsync, the vertical synchronous signal Vsync and the clock signal CLK. The timing controlling part 250 generates the horizontal start signal STH using the horizontal synchronous signal Hsync and outputs the horizontal start signal STH to the data driving part 240. In addition, the timing controlling part 250 generates the vertical start signal STV using the vertical synchronous signal Vsync and outputs the vertical start signal STV to the gate driving part 130. In addition, the timing controlling part 250 generates the first clock signal CLK1 and the second clock signal CLK2 using the clock signal CLK, outputs the first clock signal CLK1 to the gate driving part 130, and outputs the second clock signal CLK2 to the data driving part 240. In addition, the timing controlling part 250 outputs the slew rate control signal SRCS to the data driving part 240.

The timing controlling part 250 receives a mode determination signal MDS from an outside. The mode determination signal MDS may be a signal for selecting the normal mode or the FreeSync™ mode. The timing controlling part 250 includes a mode change determining part 255. The mode change determining part 255 receives the mode determination signal MDS. The mode change determining part 255 determines whether the display mode is changed or not. Specifically, the mode change determining part 255 determines whether the display mode is changed from the normal mode to the FreeSync™ mode. In addition, the mode change determining part 255 determines whether the display mode is changed from the FreeSync™ mode to the normal mode.

Figure 8:
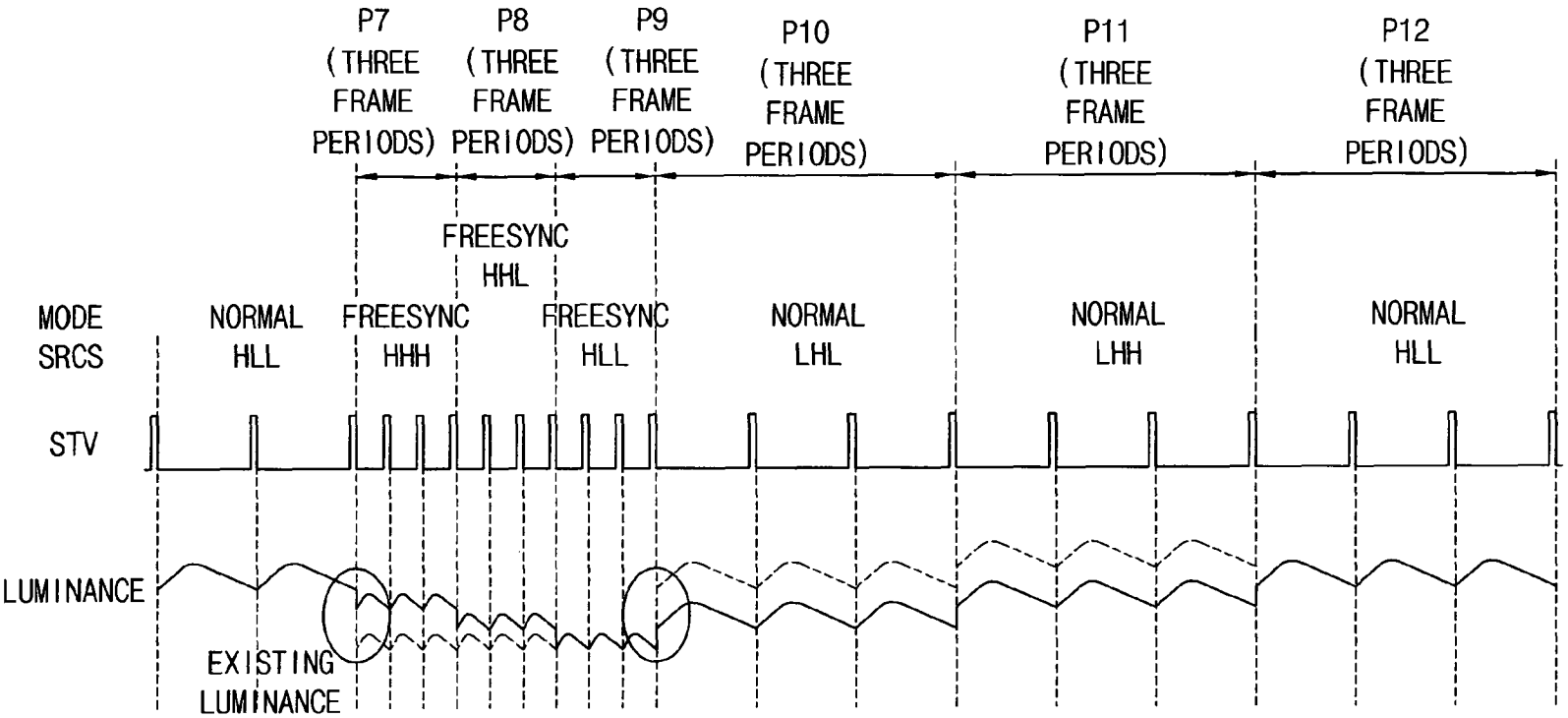
FIG. 8 is a view illustrating a slew rate control signal, a vertical start signal and a luminance of a display panel according to a display mode of an image displayed on the display panel of FIG. 7.

FIG. 8 is a view illustrating the slew rate control signal RSCS, the vertical start signal STV and the luminance of the display panel 110 according to the display mode of the image displayed on the display panel 110 of FIG. 7.

Referring to FIGS. 4A to 4E, 7 and 8, when the display mode is maintained as the normal mode, the level of the slew rate control signal SRCS may be "HLL", which is the first level. Thus, the data driving part 240 may control the data signal DS so that the transition time of the data signal DS becomes the first time T1.

When the display mode is changed from the normal mode to the FreeSync™ mode, the level of the slew rate control signal SRCS may be changed from "HLL", which is the first level, to "HHH", which is the second level. Thus, the data driving part 240 may change the transition time of the data signal DS from the first time T1 to the second time T2, which is less than the first time T1. Therefore, although the display mode is changed from the normal mode to the FreeSync™ mode, the luminance of the display panel 110 is not rapidly decreased, as compared to the prior art to which the present inventive concept is not applied. The data driving part 240 may maintain the transition time of the data signal DS as the second time T2 during a seventh period P7. The seventh period P7 may include P (P is a natural number) frame periods. For example, the seventh period P7 may include three frame periods.

After the seventh period P7, the level of the slew rate control signal SRCS may be changed from "HHH", which is the second level, to "HHL", which is the third level. Thus, after the seventh period P7, the data driving part 240 may change the transition time of the data signal DS from the second time T2 to the third time T3 between the first time T1 and the second time T2. The data driving part 240 may maintain the transition time of the data signal DS as the third time T3 during an eighth period P8 following the seventh period P7. The eighth period P8 may include Q (Q is a natural number) frame periods. For example, the eighth period P8 may include three frame periods.

After the eighth period P8, the level of the slew rate control signal SRCS may be changed from "HHL", which is the third level, to "HLL", which is the first level. Thus, after the eighth period P8, the data driving part 240 may change the transition time of the data signal DS from the third time T3 to the first time T1. Therefore, the data driving part 240 may gradually recover the transition time of the data signal DS to the transition time before the display mode is changed. The data driving part 240 may maintain the transition time of the data signal DS as the first time T1 during a ninth period P9 following the eighth period P8. The ninth period P9 may include R (R is a natural number) frame periods. For example, the ninth period P9 may include three frame periods.

When the display mode is changed from the FreeSync™ mode to the normal mode, the level of the slew rate control signal SRCS may be changed from "HLL", which is the first level, to "LHL", which is the fourth level. Thus, the data driving part 240 may change the transition time of the data signal DS from the first time T1 to the fourth time T4, which is greater than the first time T1. Therefore, although the display mode is changed from the FreeSync™ mode to the normal mode, the luminance of the display panel 110 is not rapidly increased, as compared to the prior art to which the present inventive concept is not applied. The data driving part 240 may maintain the transition time of the data signal DS as the fourth time T4 during a tenth period P10. The tenth period P10 may include S (S is a natural number) frame periods. For example, the tenth period P10 may include three frame periods.

After the tenth period P10, the level of the slew rate control signal SRCS may be changed from "LHL", which is the fourth level, to "LHH", which is the fifth level. Thus, after the tenth period P10, the data driving part 240 may change the transition time of the data signal DS from the fourth time T4 to the fifth time T5 between the first time T1 and the fourth time T4. The data driving part 240 may maintain the transition time of the data signal DS as the fifth time T5 during an eleventh fifth period P11 following the tenth period P10. The eleventh period P11 may include T (T is a natural number) frame periods. For example, the eleventh period P11 may include three frame periods.

After the eleventh period P11, the level of the slew rate control signal SRCS may be changed from "LHH", which is the fifth level, to "HLL", which is the first level. Thus, after the eleventh period P11, the data driving part 240 may change the transition time of the data signal DS from the fifth time T5 to the first time T1. Therefore, the data driving part 240 may gradually recover the transition time of the data signal DS to the transition time before the inversion method is changed. The data driving part 240 may maintain the transition time of the data signal DS as the first time T1 during a twelfth period P12 following the eleventh period P11. The twelfth period P12 may include U (U is a natural number) frame periods. For example, the twelfth period P12 may include three frame periods.

Figure 9A:
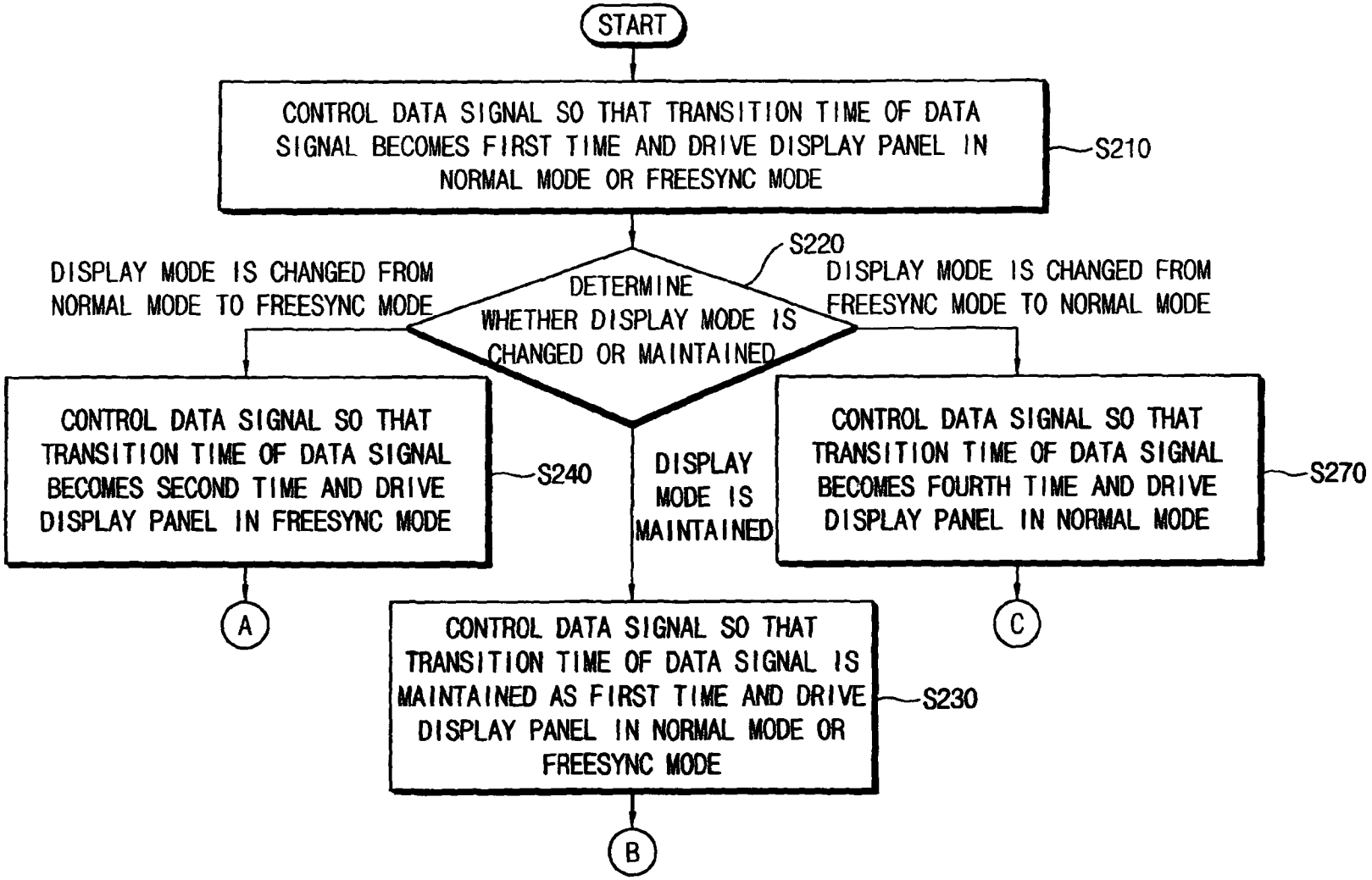
FIG. 9A and FIG. 9B are flow charts illustrating a method of driving the display apparatus of FIG. 7.
Figure 9B:
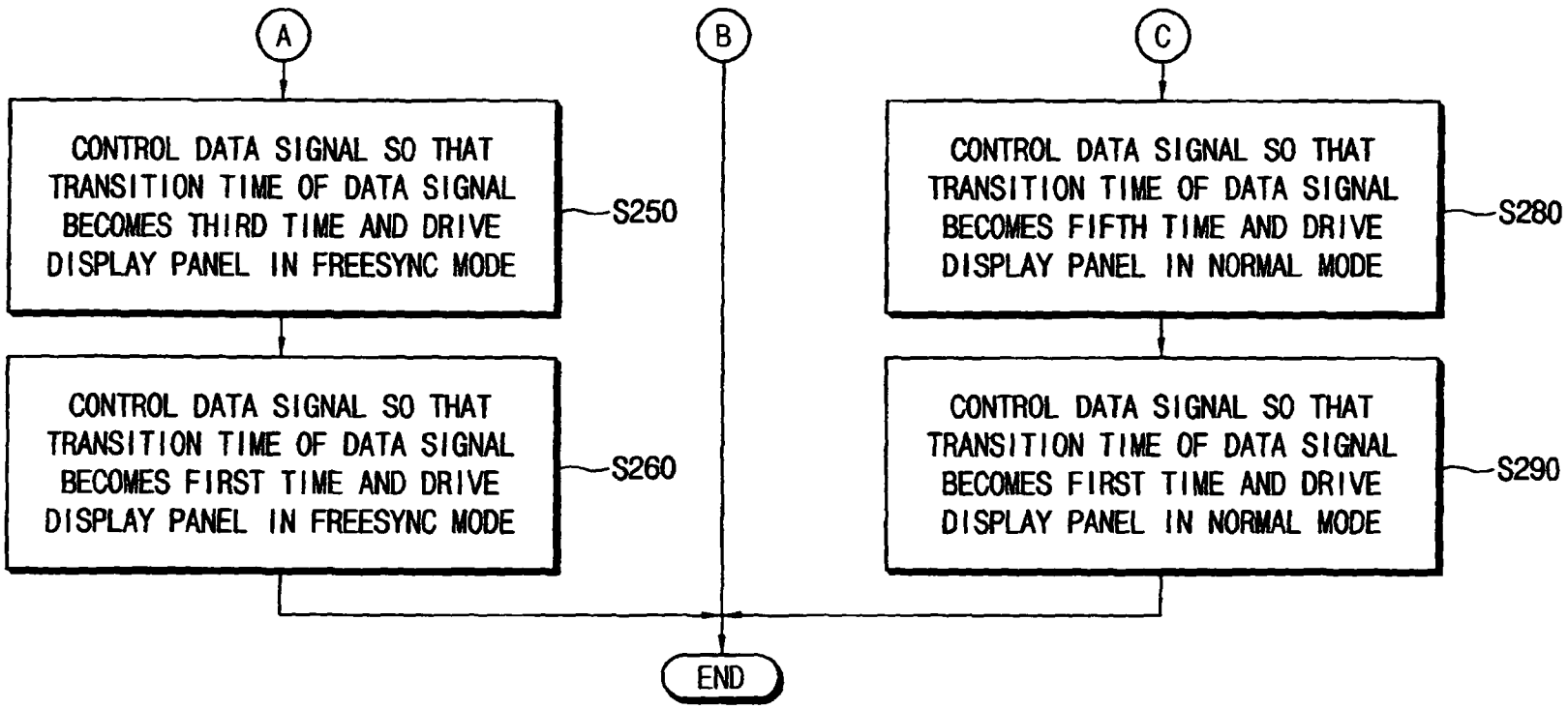

FIGS. 9A and 9B are flow charts illustrating a method of driving the display apparatus 200 of FIG. 7.

Referring to FIGS. 4A to 4E and 7 to 9B, the data signal DS is controlled so that the transition time of the data signal DS becomes the first time T1 and the display panel 110 is driven in the normal mode or the FreeSync™ mode (step S210). For example, the data driving part 240 may drive the display panel 110 in the normal mode. In this case, the level of the slew rate control signal SRCS may be "HLL", which is the first level. Thus, the data driving part 240 may control the data signal DS so that the transition time of the data signal DS becomes the first time T1.

A change or a maintenance of the display mode is determined (step S220). Specifically, the timing controlling part 250 includes the mode change determining part 255. The mode change determining part 255 receives the mode determination signal MDS. The mode change determining part 255 determines whether the display mode is changed or not. Specifically, the mode change determining part 255 determines whether the display mode is changed from the normal mode to the FreeSync™ mode. In addition, the mode change determining part 255 determines whether the display mode is changed from the FreeSync™ mode to the normal mode.

When the display mode is maintained, the data signal DS is controlled so that the transition time of the data signal DS is maintained as the first time T1 and the display panel 110 is driven in the normal mode (step S230). Specifically, when the display mode is maintained as the normal mode, the level of the slew rate control signal SRCS is maintained as "HLL" which is the first level, and thus, the data driving part 240 may control the data signal DS so that the transition time of the data signal DS is maintained as the first time T1.

When the display mode is changed from the normal mode to the FreeSync™ mode, the data signal DS is controlled so that the transition time of the data signal DS becomes the second time T2 and the display panel 110 is driven in the FreeSync™ mode (step S240). Specifically, when the display mode is changed from the normal mode to the FreeSync™ mode, the level of the slew rate control signal SRCS may be changed from "HLL", which is the first level, to "HHH", which is the second level. Thus, the data driving part 240 may change the transition time of the data signal DS from the first time T1 to the second time T2, which is less than the first time T1. Therefore, although the display mode is changed from the normal mode to the FreeSync™ mode, the luminance of the display panel 110 is not rapidly decreased, as compared to the prior art to which the present inventive concept is not applied. The data driving part 240 may maintain the transition time of the data signal DS as the second time T2 during the seventh period P7. The seventh period P7 may include P (P is a natural number) frame periods. For example, the seventh period P7 may include three frame periods.

The data signal DS is controlled so that the transition time of the data signal DS becomes the third time T3 and the display panel 110 is driven in the FreeSync™ mode (step S250). Specifically, after the seventh period P7, the level of the slew rate control signal SRCS may be changed from "HHH", which is the second level, to "HHL", which is the third level. Thus, after the seventh period P7, the data driving part 240 may change the transition time of the data signal DS from the second time T2 to the third time T3 between the first time T1 and the second time T2. The data driving part 240 may maintain the transition time of the data signal DS as the third time T3 during the eighth period P8 following the seventh period P7. The eighth period P8 may include Q (Q is a natural number) frame periods. For example, the eighth period P8 may include three frame periods.

The data signal DS is controlled so that the transition time of the data signal DS becomes the first time T1 and the display panel 110 is driven in the FreeSync™ mode (step S260). Specifically, after the eighth period P8, the level of the slew rate control signal SRCS may be changed from "HHL", which is the third level, to "HLL" which is the first level. Thus, after the eighth period P8, the data driving part 240 may change the transition time of the data signal DS from the third time T3 to the first time T1. Therefore, the data driving part 240 may gradually recover the transition time of the data signal DS to the transition time before the display mode is changed. The data driving part 240 may maintain the transition time of the data signal DS as the first time T1 during the ninth period P9 following the eighth period P8. The ninth period P9 may include R (R is a natural number) frame periods. For example, the ninth period P9 may include three frame periods.

When the display mode is changed from the FreeSync™ mode to the normal mode, the data signal DS is controlled so that the transition time of the data signal DS becomes the fourth time T4 and the display panel 110 is driven in the normal mode (step S270). Specifically, when the display mode is changed from the FreeSync™ mode to the normal mode, the level of the slew rate control signal SRCS may be changed from "HLL", which is the first level, to "LHL", which is the fourth level. Thus, the data driving part 240 may change the transition time of the data signal DS from the first time T1 to the fourth time T4, which is greater than the first time T1. Therefore, although the display mode is changed from the FreeSync™ mode to the normal mode, the luminance of the display panel 110 is not rapidly increased, compared to the prior art to which the present inventive concept is not applied. The data driving part 240 may maintain the transition time of the data signal DS as the fourth time T4 during the tenth period P10. The tenth period P10 may include S (S is a natural number) frame periods. For example, the tenth period P10 period P4 may include three frame periods.

The data signal DS is controlled so that the transition time of the data signal DS becomes the fifth time T5 and the display panel 110 is driven in the normal mode (step S280). Specifically, after the tenth period P10, the level of the slew rate control signal SRCS may be changed from "LHL", which is the fourth level, to "LHH", which is the fifth level. Thus, after the tenth period P10, the data driving part 240 may change the transition time of the data signal DS from the fourth time T4 to the fifth time T5 between the first time T1 and the fourth time T4. The data driving part 240 may maintain the transition time of the data signal DS as the fifth time T5 during the eleventh period P11 following the tenth period P10. The eleventh period P11 may include T (T is a natural number) frame periods. For example, the eleventh period P11 may include three frame periods.

The data signal DS is controlled so that the transition time of the data signal DS becomes the first time T1 and the display panel 110 is driven in the normal mode (step S290). Specifically, after the eleventh period P11, the level of the slew rate control signal SRCS may be changed from "LHH", which is the fifth level, to "HLL", which is the first level. Thus, after the eleventh period P11, the data driving part 240 may change the transition time of the data signal DS from the fifth time T5 to the first time T1. Therefore, the data driving part 240 may gradually recover the transition time of the data signal DS to the transition time before the display mode is changed. The data driving part 240 may maintain the transition time of the data signal DS as the first time T1 during the twelfth period P12 following the eleventh period P11. The twelfth period P12 may include U (U is a natural number) frame periods. For example, the twelfth period P12 may include three frame periods.

According to the present exemplary embodiment, when the display mode is changed from the normal mode to the FreeSync™ mode, the rapid decrease of the luminance of the display panel 110 may be prevented. In addition, when the display mode is changed from the FreeSync™ mode to the normal mode, the rapid increase of the luminance of the display panel 110 may be prevented. Therefore, a flicker phenomenon may be prevented, and thus display quality of the display apparatus 200 may be improved.

Figure 10:
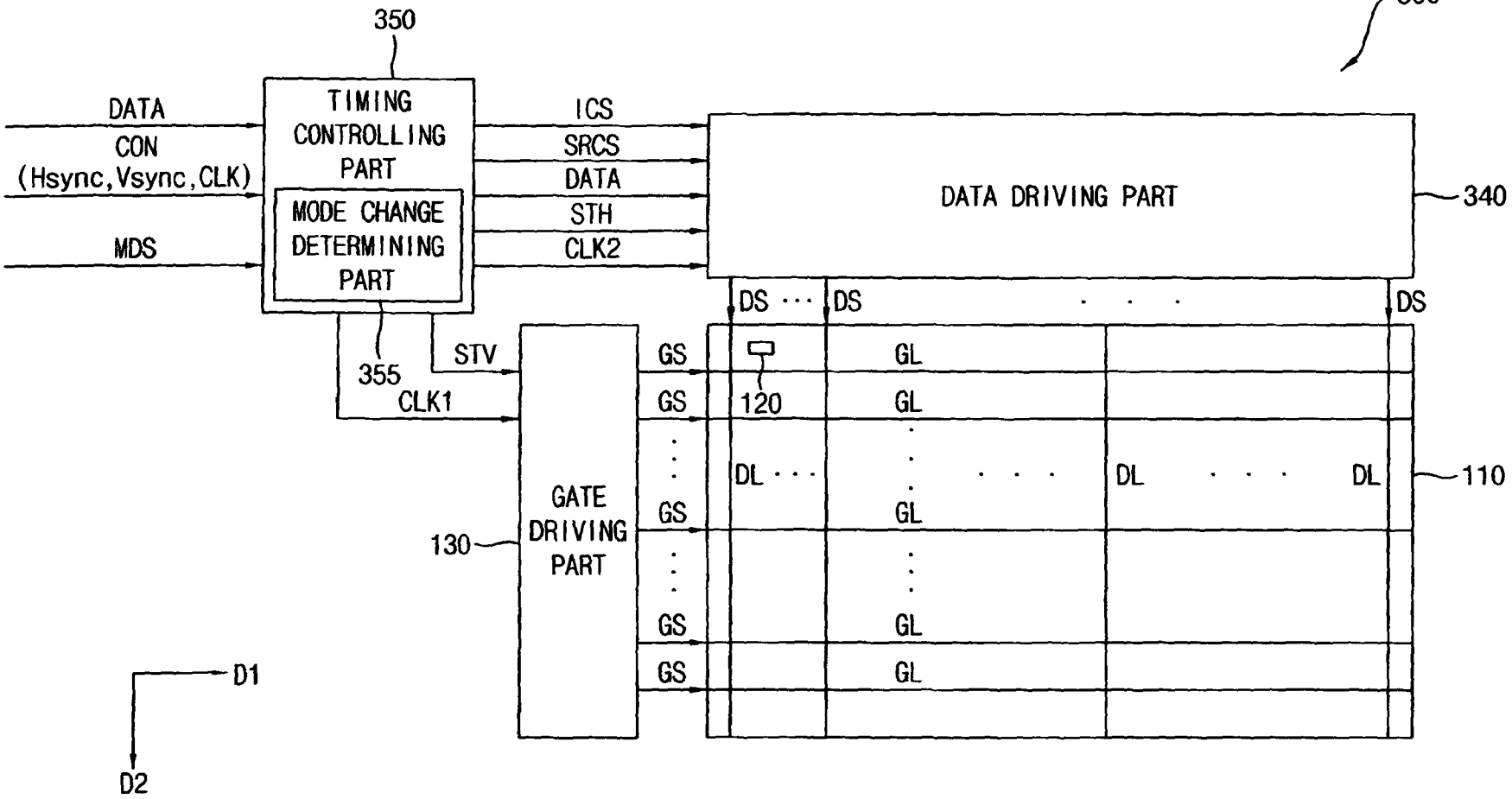
FIG. 10 is a block diagram illustrating a display apparatus according to an exemplary embodiment of the present inventive concept.

FIG. 10 is a block diagram illustrating a display apparatus according to an exemplary embodiment of the present inventive concept.

The display apparatus 300 according to the present exemplary embodiment illustrated in FIG. 10 is substantially the same as the display apparatus 100 according to the previous exemplary embodiment illustrated in FIG. 1, except for a data driving part 340 and a timing controlling part 350. In addition, the display apparatus 300 according to the present exemplary embodiment illustrated in FIG. 10 may be substantially the same as the display apparatus 200 according to the previous exemplary embodiment illustrated in FIG. 7, except for the data driving part 340 and the timing controlling part 350. Thus, the same reference numerals will be used to refer to same or like parts as those described in the previous exemplary embodiment and any further repetitive explanation concerning the above elements will be omitted.

Referring to FIG. 10, the display apparatus 300 according to the present exemplary embodiment includes the display panel 110, the gate driving part 130, the data driving part 340 and the timing controlling part 350.

The display panel 110 receives the data signal DS from the data driving part 340 to display an image.

The gate driving part 130, the data driving part 340 and the timing controlling part 350 may be defined as a display panel driving apparatus for driving the display panel 110.

The gate driving part 130 generates the gate signals GS in response to the vertical start signal STV and the first clock signal CLK1 provided from the timing controlling part 350, and outputs the gate signals GS to the gate lines GL.

The data driving part 340 includes functions of the data driving part 140 according to the previous exemplary embodiment illustrated in FIG. 1 and functions of the data driving part 240 according to the previous exemplary embodiment illustrated in FIG. 7.

Thus, the data driving part 340 receives the image data DATA from the timing controlling part 350, generates the data signal DS based on the image data DATA, and outputs the data signal DS to the data line DL in response to the horizontal start signal STH and the second clock signal CLK2 provided from the timing controlling part 350.

In addition, the data driving part 340 drives the display panel 110 in the inversion method according to the inversion control signal ICS provided from the timing controlling part 350. The inversion method may include the column inversion method and the dot inversion method.

When the inversion method is changed, the data driving part 340 may change the slew rate and the transition time of the data signal DS. Specifically, when the inversion method is changed from the column inversion method to the dot inversion method, the data driving part 340 may increase the slew rate of the data signal DS and may decrease the transition time of the data signal DS. In addition, when the inversion method is changed from the dot inversion method to the column inversion method, the data driving part 340 may decrease the slew rate of the data signal DS and may increase the transition time of the data signal DS.

In addition, the data driving part 340 controls the slew rate of the data signal DS according to the slew rate control signal SRCS provided from the timing controlling part 350. Thus, the data driving part 340 controls the transition time in which the data signal DS transits from a low level to a high level, according to the slew rate control signal SRCS. The greater the slew rate control signal SRCS, the greater the slew rate of the data signal DS may be. Thus, the greater the slew rate control signal SRCS, the shorter the transition time of the data signal DS may be.

When the display mode of the image is changed, the data driving part 340 may change the slew rate and the transition time of the data signal DS. Specifically, when the display mode is changed from the normal mode to the FreeSync™ mode, the data driving part 340 may increase the slew rate of the data signal DS and may decrease the transition time of the data signal DS. In addition, when the display mode is changed from the FreeSync™ mode to the normal mode, the data driving part 340 may decrease the slew rate of the data signal DS and may increase the transition time of the data signal DS. Here, when the display mode is the normal mode, the frame frequency of the image may be the first frequency, and the display mode is the FreeSync™ mode, the frame frequency of the image may be the second frequency greater than the first frequency. For example, the first frequency may be about 60 Hz, and the second frequency may be about 144 Hz.

The timing controlling part 350 includes functions of the timing controlling part 150 according to the previous exemplary embodiment illustrated in FIG. 1 and functions of the timing controlling part 250 according to the previous exemplary embodiment illustrated in FIG. 7.

Thus, the timing controlling part 350 receives the image data DATA and the control signal CON from an outside. The control signal CON may include the horizontal synchronous signal Hsync, the vertical synchronous signal Vsync and the clock signal CLK. The timing controlling part 350 generates the horizontal start signal STH using the horizontal synchronous signal Hsync and outputs the horizontal start signal STH to the data driving part 340. In addition, the timing controlling part 350 generates the vertical start signal STV using the vertical synchronous signal Vsync and outputs the vertical start signal STV to the gate driving part 130. In addition, the timing controlling part 350 generates the first clock signal CLK1 and the second clock signal CLK2 using the clock signal CLK, outputs the first clock signal CLK1 to the gate driving part 130, and outputs the second clock signal CLK2 to the data driving part 340. In addition, the timing controlling part 350 outputs the inversion control signal ICS and the slew rate control signal SRCS to the data driving part 340.

In addition, the timing controlling part 350 receives the mode determination signal MDS from an outside. The mode determination signal MDS may be a signal for selecting the normal mode and the FreeSync™ mode. The timing controlling part 350 includes a mode change determining part 355. The mode change determining part 355 is substantially the same as the mode change determining part 255 of the previous exemplary embodiment illustrated in FIG. 7. Thus, the mode change determining part 355 receives the mode determination signal MDS. The mode change determining part 355 determines whether the display mode is changed or not. Specifically, the mode change determining part 355 determines whether the display mode is changed from the normal mode to the FreeSync™ mode. In addition, the mode change determining part 355 determines whether the display mode is changed from the FreeSync™ mode to the normal mode.

A method of driving the display apparatus 300 of FIG. 10 may include the method of driving the display apparatus 100 according to the previous exemplary embodiment illustrated in FIGS. 6A and 6B and the method of driving the display apparatus 200 according to the previous exemplary embodiment illustrated in FIGS. 9A and 9B.

Thus, referring to FIGS. 1 and 3A to 10, the data signal DS is controlled so that the transition time of the data signal DS becomes the first time T1 and the display panel 110 is driven using the column inversion method or the dot inversion method (step S110). Specifically, the data driving part 340 may drive the display panel 110 in the column inversion method. In this case, the level of the slew rate control signal SRCS may be "HLL", which is the first level. Thus, the data driving part 340 may control the data signal DS so that the transition time of the data signal DS becomes the first time T1.

The change or the maintenance of the inversion method is determined (step S120). Specifically, since the timing controlling part 350 outputs the inversion control signal ICS to the data driving part 340, the timing controlling part 350 may determine the change or the maintenance of the inversion method.

When the inversion method is maintained, the data signal DS is controlled so that the transition time of the data signal DS is maintained as the first time T1 and the display panel 110 is driven using the column inversion method or the dot inversion method (step S130). Specifically, when the inversion method is maintained, the level of the slew rate control signal SRCS is maintained as "HLL", which is the first level, and thus the data driving part 340 may control the data signal DS so that the transition time of the data signal DS is maintained as the first time T1.

When the inversion method is changed from the column inversion method to the dot inversion method, the data signal DS is controlled so that the transition time of the data signal DS becomes the second time T2 and the display panel 110 is driven using the dot inversion method (step S140). Specifically, when the inversion method is changed from the column inversion method to the dot inversion method, the level of the slew rate control signal SRCS may be changed from "HLL", which is the first level, to "HHH", which is the second level. Thus, the data driving part 340 may change the transition time of the data signal DS from the first time T1 to the second time T2, which is less than the first time T1. Therefore, although the inversion method is changed from the column inversion method to the dot inversion method, the luminance of the display panel 110 is not rapidly decreased, compared to the prior art to which the present inventive concept is not applied. The data driving part 340 may maintain the transition time of the data signal DS as the second time T2 during the first period P1. The first period P1 may include H (H is a natural number) frame periods. For example, the first period P1 may include three frame periods.

The data signal DS is controlled so that the transition time of the data signal DS becomes the third time T3 and the display panel 110 is driven using the dot inversion method (step S150). Specifically, after the first period P1, the level of the slew rate control signal SRCS may be changed from "HHH", which is the second level, to "HHL", which is the third level. Thus, after the first period P1, the data driving part 340 may change the transition time of the data signal DS from the second time T2 to the third time T3 between the first time T1 and the second time T2. The data driving part 340 may maintain the transition time of the data signal DS as the third time T3 during the second period P2 following the first period P1. The second period P2 may include I (I is a natural number) frame periods. For example, the second period P2 may include three frame periods.

The data signal DS is controlled so that the transition time of the data signal DS becomes the first time T1 and the display panel 110 is driven using the dot inversion method (step S160). Specifically, after the second period P2, the level of the slew rate control signal SRCS may be changed from "HHL", which is the third level, to "HLL", which is the first level. Thus, after the second period P2, the data driving part 340 may change the transition time of the data signal DS from the third time T3 to the first time T1. Therefore, the data driving part 140 may gradually recover the transition time of the data signal DS to the transition time before the inversion method is changed. The data driving part 340 may maintain the transition time of the data signal DS as the first time T1 during the third period P3 following the second period P2. The third period P3 may include J (J is a natural number) frame periods. For example, the third period P3 may include three frame periods.

When the inversion method is changed from the dot inversion method to the column inversion method, the data signal DS is controlled so that the transition time of the data signal DS becomes the fourth time T4 and the display panel 110 is driven using the column inversion method (step S170). Specifically, when the inversion method is changed from the dot inversion method to the column inversion method, the level of the slew rate control signal SRCS may be changed from 'HLL' which is the first level to "LHL", which is the fourth level. Thus, the data driving part 340 may change the transition time of the data signal DS from the first time T1 to the fourth time T4, which is greater than the first time T1. Therefore, although the inversion method is changed from the dot inversion method to the column inversion method, the luminance of the display panel 110 is not rapidly increased, compared to the prior art to which the present inventive concept is not applied. The data driving part 340 may maintain the transition time of the data signal DS as the fourth time T4 during the fourth period P4. The fourth period P4 may include K (K is a natural number) frame periods. For example, the fourth period P4 may include three frame periods.

The data signal DS is controlled so that the transition time of the data signal DS becomes the fifth time T5 and the display panel 110 is driven using the column inversion method (step S180). Specifically, after the fourth period P4, the level of the slew rate control signal SRCS may be changed from "LHL", which is the fourth level, to "LHH", which is the fifth level. Thus, after the fourth period P4, the data driving part 340 may change the transition time of the data signal DS from the fourth time T4 to the fifth time T5 between the first time T1 and the fourth time T4. The data driving part 340 may maintain the transition time of the data signal DS as the fifth time T5 during the fifth period P5 following the fourth period P4. The fifth period P5 may include L (L is a natural number) frame periods. For example, the fifth period P5 may include three frame periods.

The data signal DS is controlled so that the transition time of the data signal DS becomes the first time T1 and the display panel 110 is driven using the column inversion method (step S190). Specifically, after the fifth period P5, the level of the slew rate control signal SRCS may be changed from "LHH", which is the fifth level, to "HLL", which is the first level. Thus, after the fifth period P5, the data driving part 340 may change the transition time of the data signal DS from the fifth time T5 to the first time T1. Therefore, the data driving part 340 may gradually recover the transition time of the data signal DS to the transition time before the inversion method is changed. The data driving part 340 may maintain the transition time of the data signal DS as the first time T1 during the sixth period P6 following the fifth period P5. The sixth period P6 may include M (M is a natural number) frame periods. For example, the sixth period P6 may include three frame periods.

In addition, the data signal DS is controlled so that the transition time of the data signal DS becomes the first time T1 and the display panel 110 is driven in the normal mode or the FreeSync™ mode (step S210). For example, the data driving part 340 may drive the display panel 110 in the normal mode. In this case, the level of the slew rate control signal SRCS may be "HLL", which is the first level. Thus, the data driving part 340 may control the data signal DS so that the transition time of the data signal DS becomes the first time T1.

The change or the maintenance of the display mode is determined (step S220). Specifically, the timing controlling part 350 includes the mode change determining part 355. The mode change determining part 355 receives the mode determination signal MDS. The mode change determining part 355 determines whether the display mode is changed or not. Specifically, the mode change determining part 355 determines whether the display mode is changed from the normal mode to the FreeSync™ mode. In addition, the mode change determining part 355 determines whether the display mode is changed from the FreeSync™ mode to the normal mode.

When the display mode is maintained, the data signal DS is controlled so that the transition time of the data signal DS is maintained as the first time T1 and the display panel 110 is driven in the normal mode (step S230). Specifically, when the display mode is maintained as the normal mode, the level of the slew rate control signal SRCS is maintained as "HLL", which is the first level, and thus, the data driving part 340 may control the data signal DS so that the transition time of the data signal DS is maintained as the first time T1.

When the display mode is changed from the normal mode to the FreeSync™ mode, the data signal DS is controlled so that the transition time of the data signal DS becomes the second time T2 and the display panel 110 is driven in the FreeSync™ mode (step S240). Specifically, when the display mode is changed from the normal mode to the FreeSync™ mode, the level of the slew rate control signal SRCS may be changed from "HLL", which is the first level, to "HHH", which is the second level. Thus, the data driving part 340 may change the transition time of the data signal DS from the first time T1 to the second time T2, which is less than the first time T1. Therefore, although the display mode is changed from the normal mode to the FreeSync™ mode, the luminance of the display panel 110 is not rapidly decreased, compared to the prior art to which the present inventive concept is not applied. The data driving part 340 may maintain the transition time of the data signal DS as the second time T2 during the seventh period P7. The seventh period P7 may include P (P is a natural number) frame periods. For example, the seventh period P7 may include three frame periods.

The data signal DS is controlled so that the transition time of the data signal DS becomes the third time T3 and the display panel 110 is driven in the FreeSync™ mode (step S250). Specifically, after the seventh period P7, the level of the slew rate control signal SRCS may be changed from "HHH", which is the second level, to "HHL", which is the third level. Thus, after the seventh period P7, the data driving part 240 may change the transition time of the data signal DS from the second time T2 to the third time T3 between the first time T1 and the second time T2. The data driving part 340 may maintain the transition time of the data signal DS as the third time T3 during the eighth period P8 following the seventh period P7. The eighth period P8 may include Q (Q is a natural number) frame periods. For example, the eighth period P8 may include three frame periods.

The data signal DS is controlled so that the transition time of the data signal DS becomes the first time T1 and the display panel 110 is driven in the FreeSync™ mode (step S260). Specifically, after the eighth period P8, the level of the slew rate control signal SRCS may be changed from "HHL", which is the third level, to "HLL", which is the first level. Thus, after the eighth period P8, the data driving part 340 may change the transition time of the data signal DS from the third time T3 to the first time T1. Therefore, the data driving part 340 may gradually recover the transition time of the data signal DS to the transition time before the display mode is changed. The data driving part 340 may maintain the transition time of the data signal DS as the first time T1 during the ninth period P9 following the eighth period P8. The ninth period P9 may include R (R is a natural number) frame periods. For example, the ninth period P9 may include three frame periods.

When the display mode is changed from the FreeSync™ mode to the normal mode, the data signal DS is controlled so that the transition time of the data signal DS becomes the fourth time T4 and the display panel 110 is driven in the normal mode (step S270). Specifically, when the display mode is changed from the FreeSync™ mode to the normal mode, the level of the slew rate control signal SRCS may be changed from "HLL", which is the first level, to "LHL", which is the fourth level. Thus, the data driving part 340 may change the transition time of the data signal DS from the first time T1 to the fourth time T4, which is greater than the first time T1. Therefore, although the display mode is changed from the FreeSync™ mode to the normal mode, the luminance of the display panel 110 is not rapidly increased, compared to the prior art to which the present inventive concept is not applied. The data driving part 340 may maintain the transition time of the data signal DS as the fourth time T4 during the tenth period P10. The tenth period P10 may include S (S is a natural number) frame periods. For example, the tenth period P10 period P4 may include three frame periods.

The data signal DS is controlled so that the transition time of the data signal DS becomes the fifth time T5 and the display panel 110 is driven in the normal mode (step S280). Specifically, after the tenth period P10, the level of the slew rate control signal SRCS may be changed from "LHL", which is the fourth level, to "LHH", which is the fifth level. Thus, after the tenth period P10, the data driving part 340 may change the transition time of the data signal DS from the fourth time T4 to the fifth time T5 between the first time T1 and the fourth time T4. The data driving part 340 may maintain the transition time of the data signal DS as the fifth time T5 during the eleventh period P11 following the tenth period P10. The eleventh period P11 may include T (T is a natural number) frame periods. For example, the eleventh period P11 may include three frame periods.

The data signal DS is controlled so that the transition time of the data signal DS becomes the first time T1 and the display panel 110 is driven in the normal mode (step S290). Specifically, after the eleventh period P11, the level of the slew rate control signal SRCS may be changed from "LHH", which is the fifth level, to "HLL", which is the first level. Thus, after the eleventh period P11, the data driving part 340 may change the transition time of the data signal DS from the fifth time T5 to the first time T1. Therefore, the data driving part 340 may gradually recover the transition time of the data signal DS to the transition time before the display mode is changed. The data driving part 340 may maintain the transition time of the data signal DS as the first time T1 during the twelfth period P12 following the eleventh period P11. The twelfth period P12 may include U (U is a natural number) frame periods. For example, the twelfth period P12 may include three frame periods.

According to the present exemplary embodiment, when the inversion method is changed from the column inversion method to the dot inversion method, rapid decrease of the luminance of the display panel 110 may be prevented. In addition, when the inversion method is changed from the dot inversion method to the column inversion method, rapid increase of the luminance of the display panel 110 may be prevented. In addition, when the display mode is changed from the normal mode to the FreeSync™ mode, rapid decrease of the luminance of the display panel 110 may be prevented. In addition, when the display mode is changed from the FreeSync™ mode to the normal mode, rapid increase of the luminance of the display panel 110 may be prevented. Therefore, a flicker phenomenon may be prevented, and thus, display quality of the display apparatus 300 may be improved.

The present inventive concept may be applied to an electronic device having a display apparatus. For example, the present inventive concept may be applied to a television, a computer monitor, a laptop, a digital camera, a cellular phone, a smart phone, a tablet Personal Computer (PC), a smart pad, a Personal Digital Assistant (PDA), a Portable Multimedia Player (PMP), an MP3 player, a navigation system, a camcorder, a portable game console, etc.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus comprising:

a display panel configured to display an image, the display panel comprising a gate line and a data line;

a gate driving part configured to output a gate signal to the gate line; and a data driving part configured to output a data signal to the data line, and to change a transition time defined as a time duration in which the data signal transits from a low level to a high level, wherein the transition time is adjusted to be increased or decreased according to at least one of a change of an inversion method for driving the display panel, and a change of a frame frequency of the image.

2. The display apparatus of claim 1, wherein the inversion method comprises:

a column inversion method in which polarities of the data signal applied to the data line are alternately inverted in a plurality of frame periods; and a dot inversion method in which the polarities of the data signal applied to the data line are inverted in each of the frame periods.

3. The display apparatus of claim 2, wherein, in response to a change of the inversion method from the column inversion method to the dot inversion method, the data driving part is configured to change the transition time of the data signal from a first time to a second time having a duration which is less than the first time.

4. The display apparatus of claim 3, wherein the data driving part is configured to maintain the transition time of the data signal as the second time during a first period, and the first period comprises H (H is a natural number) frame periods.

5. The display apparatus of claim 4, wherein:

the data driving part is configured to, after the first period, change the transition time of the data signal from the second time to a third time having a duration which is less than the first time and greater than the second time, and maintain the transition time of the data signal as the third time during a second period following the first period; and the second period comprises I (I is a natural number) frame periods.

6. The display apparatus of claim 5, wherein:

the data driving part is configured to, after the second period, change the transition time of the data signal from the third time to the first time, and maintain the transition time of the data signal as the first time during a third period following the second period; and the third period comprises J (J is a natural number) frame periods.

7. The display apparatus of claim 2, wherein, in response to a change of the inversion method from the dot inversion method to the column inversion method, the data driving part is configured to change the transition time of the data signal from a first time to a fourth time having a duration which is greater than the first time.

8. The display apparatus of claim 7, wherein the data driving part is configured to maintain the transition time of the data signal as the fourth time during a fourth period, and the fourth period comprises K (K is a natural number) frame periods.

9. The display apparatus of claim 8, wherein:

the data driving part is configured to, after the fourth period, change the transition time of the data signal from the fourth time to a fifth time having a duration which is greater than the first time and less than the fourth time, and maintain the transition time of the data signal as the fifth time during a fifth period following the fourth period; and the fifth period comprises L (L is a natural number) frame periods.

10. The display apparatus of claim 9, wherein:

the data driving part is configured to, after the fifth period, change the transition time of the data signal from the fifth time to the first time, and maintain the transition time of the data signal as the first time during a sixth period following the fifth period; and the sixth period comprises M (M is a natural number) frame periods.

11. The display apparatus of claim 10, wherein, when the frame frequency is changed from a first frequency to a second frequency higher than the first frequency, the data driving part is configured to change the transition time of the data signal from a first time to a second time having a duration which is less than the first time.

12. The display apparatus of claim 11, wherein:

the data driving part is configured to maintain the transition time of the data signal as the second time during a seventh period; and the seventh period comprises P (P is a natural number) frame periods.

13. The display apparatus of claim 12, wherein:

the data driving part is configured to, after the seventh period, change the transition time of the data signal from the second time to the third time having a duration which is less than the first time and greater than the second time, and maintain the transition time of the data signal as the third time during an eighth period following the seventh period; and the eighths period comprises Q (Q is a natural number) frame periods.

14. The display apparatus of claim 13, wherein:

the data driving part is configured to, after the eighth period, change the transition time of the data signal from the third time to the first time, and maintain the transition time of the data signal as the first time during a ninth period following the eighth period; and the ninth period comprises R (R is a natural number) frame periods.

15. The display apparatus of claim 1, wherein, in response to a change of the frame frequency from a second frequency to a first frequency less than the first frequency, the data driving part is configured to change the transition time of the data signal from a first time to a fourth time having a duration which is greater than the first time.

16. The display apparatus of claim 15, wherein the data driving part is configured to maintain the transition time of the data signal as the fourth time during a tenth period, and the tenth period comprises S (S is a natural number) frame periods.

17. The display apparatus of claim 16, wherein:

the data driving part is configured to, after the tenth period, change the transition time of the data signal from the fourth time to the fifth time having a duration which is greater than the first time and less than the fourth time, and maintain the transition time of the data signal as the fifth time during an eleventh period following the tenth period; and the eleventh period comprises T (T is a natural number) frame periods.

18. The display apparatus of claim 17, wherein:

the data driving part is configured to, after the eleventh period, change the transition time of the data signal from the fifth time to the first time, and maintain the transition time of the data signal as the first time during a twelfth period following the eleventh period; and the twelfth period comprises U (U is a natural number) frame periods.

19. A method of driving a display apparatus comprising a display panel comprising a gate line and a data line, the method comprising:

outputting a gate signal to the gate line of the display panel; and outputting a data signal to the data line, by changing a transition time defined as a time duration in which the data signal transits from a low level to a high level, wherein the transition time is adjusted to be increased or decreased according to at least one of a change of an inversion method for driving the display panel, and a change of a frame frequency of the image.

20. The method of claim 19, wherein the changing the transition time comprises:

changing the transition time, in response to a change of the inversion method from a column inversion method in which polarities of the data signal applied to the data line are alternately inverted in a plurality of frame periods, to a dot inversion method in which the polarities of the data signal applied to the data line are inverted in each of the frame periods;

changing the transition time in which the inversion method is changed from the dot inversion method to the column inversion method;

changing the transition time in which the frame frequency is changed from a first frequency to a second frequency greater than the first frequency; and changing the transition time in which the frame frequency is changed from the second frequency to the first frequency.

* * * * *